US011720037B2

(12) United States Patent
Nogami et al.

(10) Patent No.: US 11,720,037 B2
(45) Date of Patent: Aug. 8, 2023

(54) IMAGE FORMING APPARATUS

(71) Applicant: CANON KABUSHIKI KAISHA, Tokyo (JP)

(72) Inventors: Kazuaki Nogami, Saitama (JP); Akinori Mitsumata, Tokyo (JP); Takeo Kawanami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/493,669

(22) Filed: Oct. 4, 2021

(65) Prior Publication Data

US 2022/0113651 A1 Apr. 14, 2022

(30) Foreign Application Priority Data

Oct. 8, 2020 (JP) ..... 2020-170748

(51) Int. Cl.
*G03G 21/08* (2006.01)
*G03G 15/04* (2006.01)

(52) U.S. Cl.
CPC ..... *G03G 15/04036* (2013.01); *G03G 21/08* (2013.01); *G03G 2221/1684* (2013.01)

(58) Field of Classification Search
CPC ..... G03G 21/08; G03G 2221/1684
See application file for complete search history.

(56) References Cited

U.S. PATENT DOCUMENTS 4,534,641 A * 8/1985 Gilliland ..... G03G 21/08 355/1
6,678,491 B2 * 1/2004 Kido ..... G03G 21/08 399/113
7,498,559 B2 * 3/2009 Nishimura ..... G03G 21/08 399/128
9,207,623 B2 * 12/2015 Kamiyama ..... G03G 21/0005
2009/0324286 A1 * 12/2009 Okabe ..... G03G 21/08 399/128
2010/0080623 A1 * 4/2010 Tanaka ..... G03G 21/1666 399/118

(Continued)

FOREIGN PATENT DOCUMENTS

JP 2009053603 A 3/2009
JP 2016177271 A 10/2016

(Continued)

*Primary Examiner* — Carla J Therrien
(74) *Attorney, Agent, or Firm* — Canon U.S.A., Inc. I.P. Division

(57) ABSTRACT

An image forming apparatus includes an image bearing member, a charging member to charge a surface of the image bearing member, an exposure unit, a developing member to form a toner image, a transfer member, an irradiation unit, and a blocking member. The irradiation unit includes a light source provided at one end of the irradiation unit in a rotation axial direction of the image bearing member and a guide that guides a light source emitted light in the rotation axial direction. The irradiation unit irradiates the surface of the image bearing member with the light after the transfer member transfers the toner image to a transfer-receiving member. The blocking member blocks the light irradiated from the irradiation unit in the rotation axial direction. The blocking member is configured so that a quantity of blocking the light irradiated from the irradiation unit is different in the rotation axial direction.

13 Claims, 13 Drawing Sheets

(56) References Cited

U.S. PATENT DOCUMENTS

| | | | | |
|---|---|---|---|---|
| 2010/0183333 | A1 | 7/2010 | Kim | |
| 2017/0315464 | A1* | 11/2017 | Oi | G03G 15/0189 |
| 2019/0163116 | A1* | 5/2019 | Saito | G03G 21/08 |
| 2021/0096479 | A1* | 4/2021 | Sawashima | G03G 15/1685 |
| 2021/0364975 | A1* | 11/2021 | Kawajiri | G03G 21/0094 |

FOREIGN PATENT DOCUMENTS

| | | | |
|---|---|---|---|
| JP | 2017198820 | A | 11/2017 |
| JP | 2018132743 | A | 8/2018 |
| JP | 2020056937 | A | 4/2020 |

* cited by examiner

IMAGE FORMING APPARATUS

BACKGROUND OF THE DISCLOSURE

Field of the Disclosure

The present disclosure relates to an image forming apparatus.

Description of the Related Art

The image forming apparatus forms an electrostatic latent image on a photosensitive drum as an image bearing member by uniformly charging the photosensitive drum to a predetermined potential by discharge from a charging member and then performing exposure according to an image pattern. After that, the image forming apparatus develops the electrostatic latent image on the photosensitive drum with toner to be actualized into a toner image, and transfers the toner image to a recording material such as paper. When the surface of the photosensitive drum is charged, if there is a residual charge on the surface of the photosensitive drum, the surface potential of the photosensitive drum may become uneven. As a result, an image defect called a drum ghost may occur due to a potential difference formed on the photosensitive drum between an image forming area in which a toner image is formed and a non-image forming area in which no toner image is formed. Therefore, in order to eliminate the potential difference formed on the surface of the photosensitive drum, it is known to be effective to provide a so-called charge eliminating member which eliminates the surface potential of the photosensitive drum to a predetermined potential by irradiating the surface of the photosensitive drum with light before the charging step. The charge eliminating member is called a pre-exposure unit. The pre-exposure unit may be a combination of an LED (light emitting diode) or an LED circuit board and a light guide unit such as a light guide. These techniques are useful as systems for eliminating charges over the entire length of the photosensitive drum. However, in recent years, in consideration of the cost, rather than providing the LED over the entire range in the longitudinal direction of the photosensitive drum, a light guide having the LED provided at the end in the longitudinal direction of the photosensitive drum is often employed (Japanese Patent Application Laid-open No. 2018-132743 and Japanese Patent Application Laid-open No. 2009-053603).

However, when the light guide is used as the pre-exposure unit, there are the following issues. When the light guide is used, the charge is eliminated from the photosensitive drum by irradiating light from the end in the longitudinal direction. Therefore, the quantity of light on the surface of the photosensitive drum becomes large on the incident side of the light, and the charge elimination quantity of the photosensitive drum becomes uneven in the longitudinal direction. In order to eliminate the charge elimination unevenness in the longitudinal direction, there is known a method of measuring the charge elimination quantity on the photosensitive drum after pre-exposure and adjusting the charge elimination quantity so that the charge elimination quantity in the longitudinal direction becomes uniform when an image is exposed by an exposure unit. Also, there is known a method in which the sensitivity of the photosensitive drum in the longitudinal direction is adjusted by changing the thickness of the layer of the photosensitive drum to equalize the charge elimination unevenness.

However, according to the conventional art, it is necessary to provide a detector configured to detect the charge elimination quantity on the photosensitive drum and manage the layer in the longitudinal direction of the photosensitive drum, which requires much labor and cost. Further, in the conventional art, since it is not possible to reduce the quantity of light irradiated onto the incident side of the photosensitive drum itself, it is difficult to solve the concern about the lifetime due to the influence (hereinafter also referred to as light deterioration) on the photosensitive drum caused by the irradiation of light.

SUMMARY OF THE DISCLOSURE

The present disclosure discloses an imaging forming apparatus that works towards suppressing unevenness in charge elimination in the longitudinal direction of a photosensitive drum in a configuration in which a light guide is provided in a pre-exposure unit.

According to an aspect of the present disclosure, an image forming apparatus includes an image bearing member configured to be rotated, a charging member configured to charge a surface of the image bearing member, an exposure unit configured to form an electrostatic latent image on the surface of the image bearing member charged by the charging member, a developing member configured to develop the electrostatic latent image formed by the exposure unit with toner to form a toner image, a transfer member configured to transfer the toner image formed on the surface of the image bearing member by the developing member to a transfer-receiving member, an irradiation unit having a light source provided at one end of the irradiation unit in a rotation axial direction of the image bearing member and a guide configured to guide a light emitted from the light source in the rotation axial direction, wherein the irradiation unit is configured to irradiate the surface of the image bearing member with the light after the toner image is transferred to the transfer-receiving member by the transfer member, and a blocking member configured to block the light irradiated from the irradiation unit in the rotation axial direction, wherein the blocking member is configured so that a quantity of blocking the light irradiated from the irradiation unit is different in the rotation axial direction.

Further features of the present disclosure will become apparent from the following description of exemplary embodiments with reference to the attached drawings.

DESCRIPTION OF THE EMBODIMENTS

Hereinafter, an embodiment for carrying out the present disclosure relating to an image forming apparatus will be described in detail with reference to the drawings according to the embodiments. The image forming apparatus forms an image on a recording material (recording medium) by using an electrophotographic image forming method. Examples of the image forming apparatus include, for example, a copying machine, a printer (a laser beam printer, an LED printer, etc.), a facsimile machine, a word processor, and a multifunction peripheral (multifunction printer).

[1. Image Forming Apparatus]

Figure 1A:
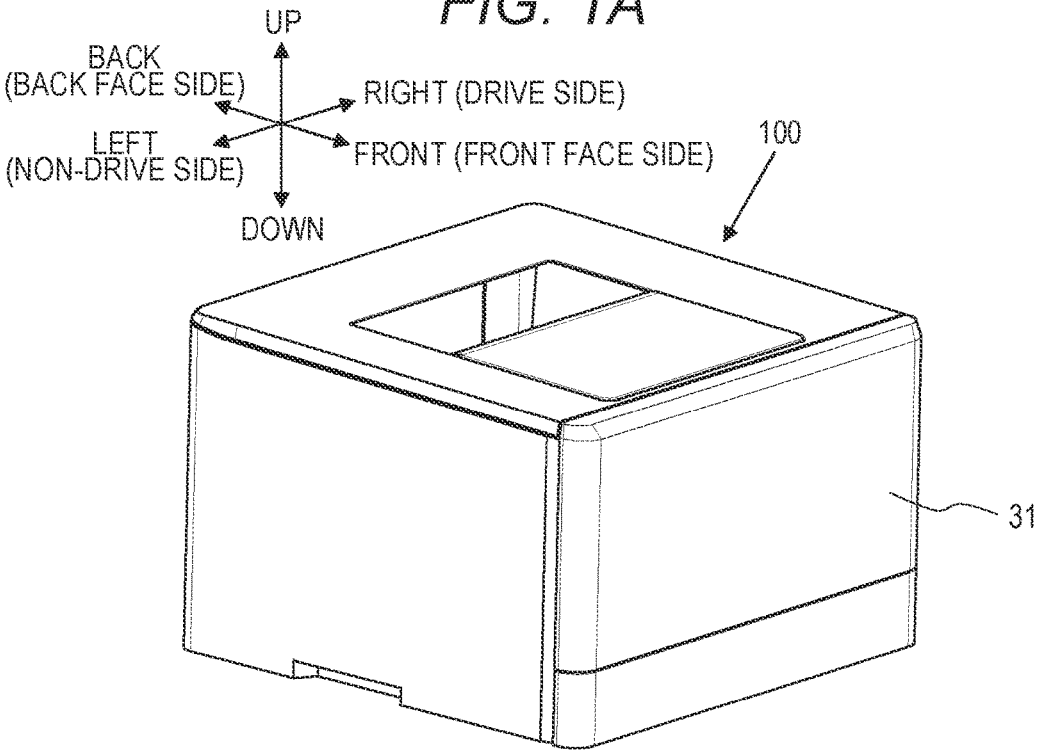
FIG. 1A is an external perspective view of an image forming apparatus of a first embodiment.
Figure 1B:
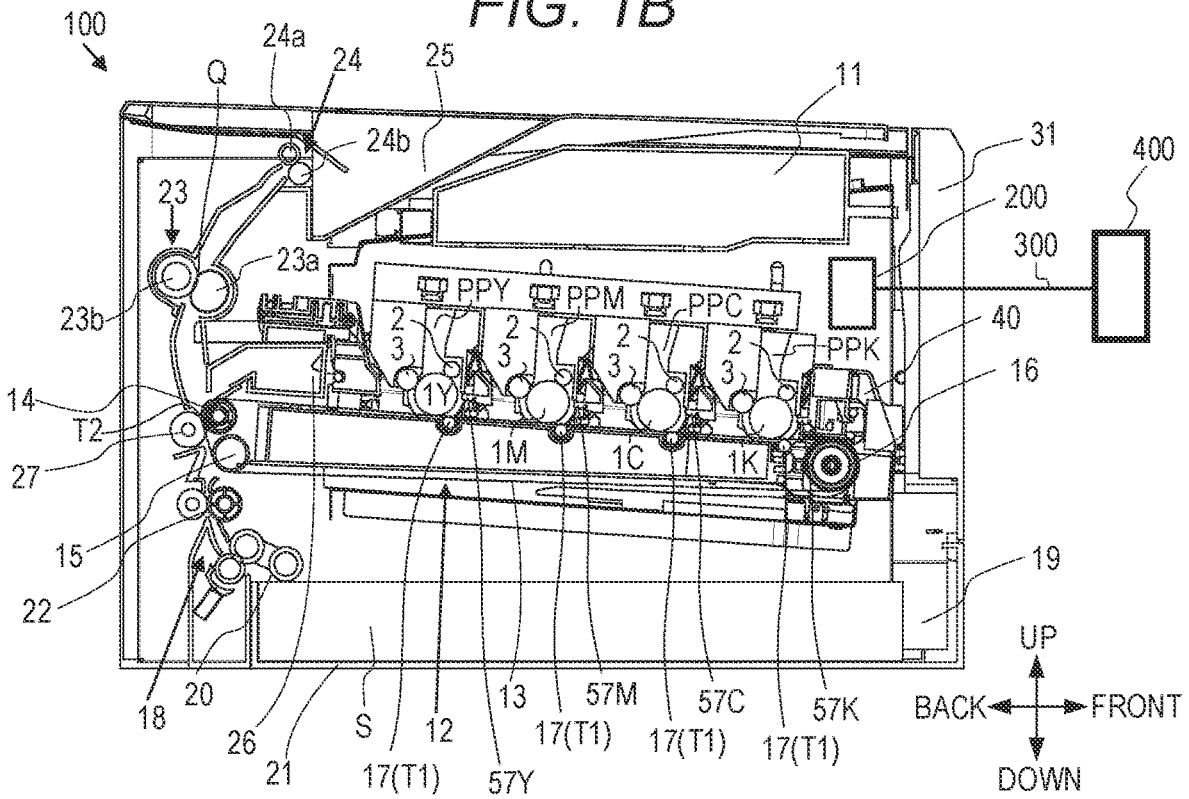
FIG. 1B is a sectional view of the image forming apparatus of the first embodiment.

A schematic configuration of the image forming apparatus 100 of the first embodiment will be described with reference to FIG. 1A and FIG. 1B. FIG. 1A is an external perspective view of the image forming apparatus 100. FIG. 1B is a sectional view of the image forming apparatus 100. The image forming apparatus 100 includes a front door 31. As shown in FIG. 1B, the image forming apparatus 100 is a four-color full-color printer (electrophotographic image forming apparatus) using an electrophotographic process having four process cartridges as a plurality of cartridges, that is, a first process cartridge PPY, a second process cartridge PPM, a third process cartridge PPC, and a fourth process cartridge PPK.

The image forming apparatus 100 forms a full-color image or a monochrome image on a sheet S which is a sheet-like recording material based on an electrical image signal outputted from a controller 400 which is an external host device and inputted to a control unit 200 through an interface portion 300. The controller 400 may be a personal computer, an image reader, a facsimile, a smartphone, or the like. The control unit 200 controls the electrophotographic image forming process of the image forming apparatus 100. The control unit 200 exchanges various kinds of electrical information with the controller 400. The control unit 200 performs processing of electrical information inputted from various process devices and sensors, processing of command signals to various process devices, predetermined initial sequence control, sequence control of a predetermined electrophotographic image forming process, and the like.

In the following description, as shown in FIG. 1A, with respect to the image forming apparatus 100, a front side is a side on which a front door 31 is disposed. A back side (back face side) is a side opposite to the front side. A front-back direction is a direction (forward direction) from the back side to the front side of the image forming apparatus 100 and a direction (backward direction) opposite thereto. Left and right refer to the left and the right as viewed from the front side of the image forming apparatus 100. The left-right direction is a direction (left direction) from right to left and a direction (right direction) opposite thereto. Up and down refer to the up and the down in the direction of gravity. The upward direction is a direction from the down to the up and the downward direction is a direction from the up to the down. A longitudinal direction is a direction parallel to a rotation axial direction of the electrophotographic photosensitive drum 1 (hereinafter referred to as a photosensitive drum 1), which is an image bearing member on which an electrostatic latent image is formed. A short direction is a direction (orthogonal direction) orthogonal to the longitudinal direction. One end side in the longitudinal direction is a drive side, and the other end side is a non-drive side.

In the first embodiment, the right end side in the longitudinal direction is the drive side, and the left end side is the non-drive side. Inside the image forming apparatus 100, four first to fourth process cartridges PPY, PPM, PPC, and PPK are held in a cartridge tray 40 from the back side to the front side of the image forming apparatus 100. The cartridge tray 40 (inline configuration, tandem) holding the process cartridges PPY, PPM, PPC, and PPK is mounted at a predetermined position (mounting position). The cartridge tray 40 will be described later in detail.

Four color image forming stations are shown in FIG. 1B. In order from the left in FIG. 1B, the image forming stations configured to form yellow, magenta, cyan and black images are arranged. The suffix letters Y, M, C, and K added to the reference numerals or the reference symbols in FIG. 1B indicate components of the stations that form yellow, magenta, cyan, and black toner images on the surfaces of the photosensitive drums 1, respectively. Since the configurations of the stations configured to form yellow, magenta, cyan, and black images are common, one of the stations will be described below. In the following description, the suffix letters Y, M, C, and K will be omitted, except in the case where components related to specific colors are described.

Figure 2B:
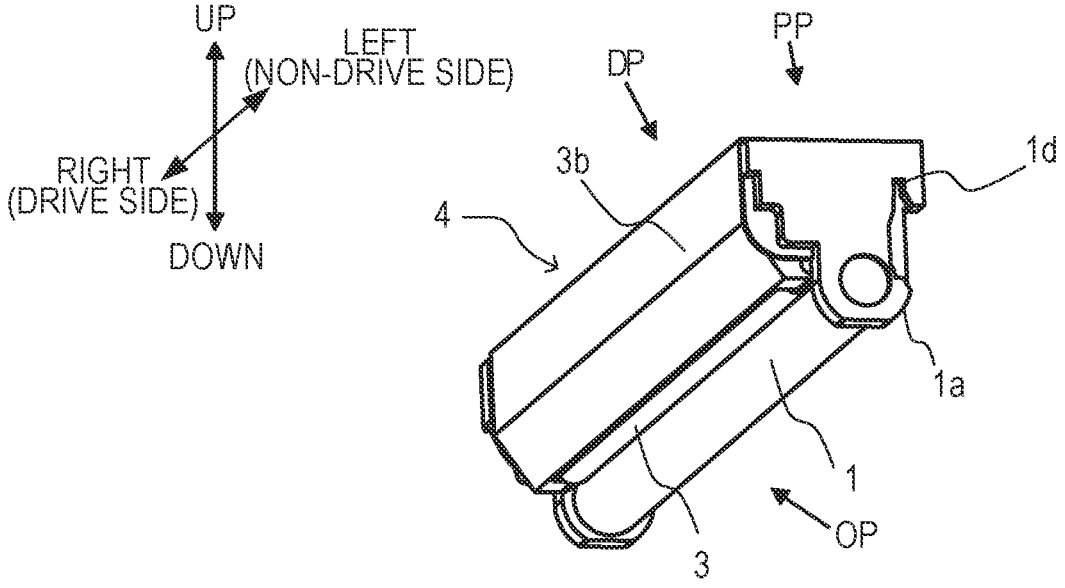
Figure 3:
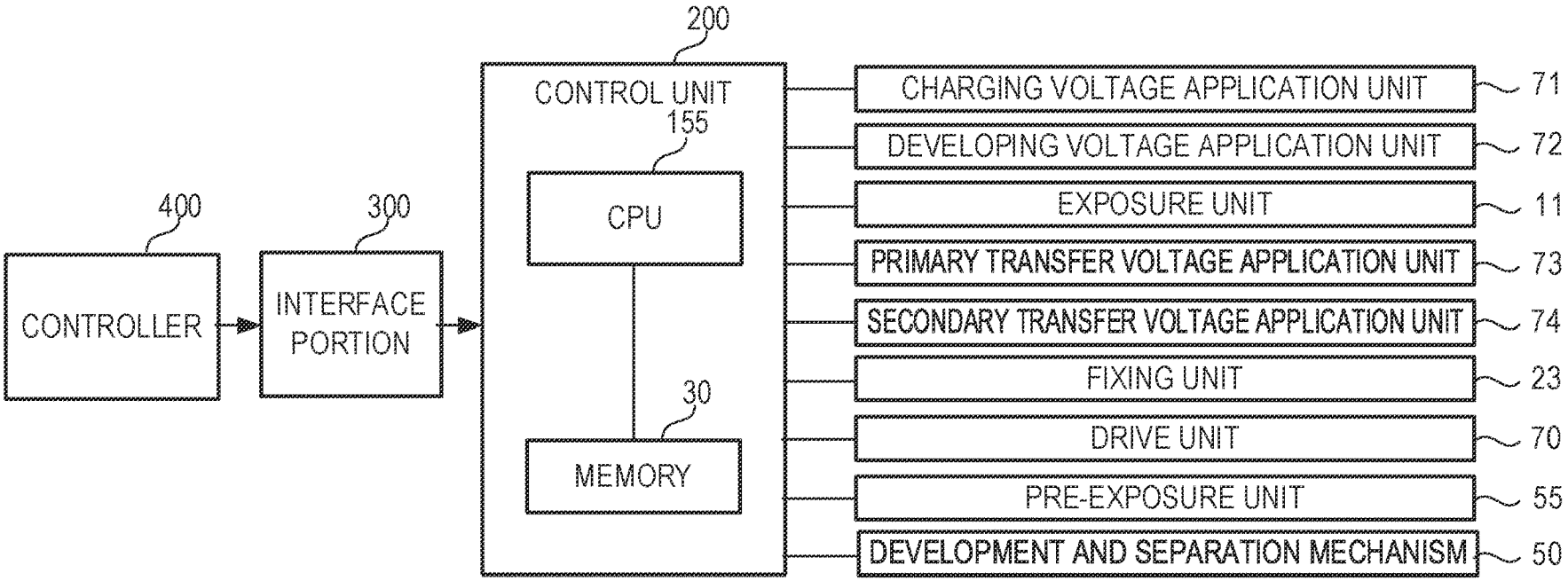
FIG. 3 is a control block diagram of the image forming apparatus of the first embodiment.

The cylindrical photosensitive drum 1 rotates about its axis (hereinafter referred to as a rotational axis). The surface of the photosensitive drum 1 is uniformly charged by a contact charging device as a charging member, for example, a charging roller 2, and then an electrostatic latent image is formed by an exposure unit 11. The charging roller 2 has a core metal and a conductive elastic body layer formed concentrically and integrally around the core metal, and a charging voltage is applied to the core metal by a charging voltage application unit 71 (FIG. 3). The developing unit DP (FIG. 2B), which is a developing member, contains toner as a one-component developer. The toner having a predetermined charge polarity is supplied to the electrostatic latent image on the photosensitive drum 1 by a developing roller 3 which is a toner carrying member and a developing member, and is visualized (developed) as a toner image. The developing roller 3 has a core metal and a conductive elastic body layer formed concentrically and integrally around the core metal, and a developing voltage is applied to the core metal by a developing voltage application unit 72 (FIG. 3). The toner image on the photosensitive drum 1 is electrostatically transferred to an intermediate transfer unit 12 by a primary transfer roller 17, which is a transfer unit to which a transfer voltage is applied by a primary transfer voltage application unit 73 (FIG. 3). The primary transfer roller 17 is formed in the shape of a roller provided with a conductive elastic layer on its shaft, and a voltage is applied to the shaft. The toner images of the respective colors are sequentially transferred (primary transfer) onto an intermediate transfer member which is a transfer-receiving member, for example, an intermediate transfer belt 13, to form a full-color toner image. Thereafter, the full-color toner image is transferred to the sheet S by a secondary transfer roller 27 serving as a secondary transfer unit (secondary transfer). The sheet S carrying the unfixed toner is conveyed to a fixing unit 23, and the unfixed toner is thermally fused and mixed by the fixing unit 23, fixed as a permanent image on the sheet S, and the sheet S is discharged as an image-formed matter. The image forming operation will be described in detail later.

(Process Cartridge)

Figure 2A:
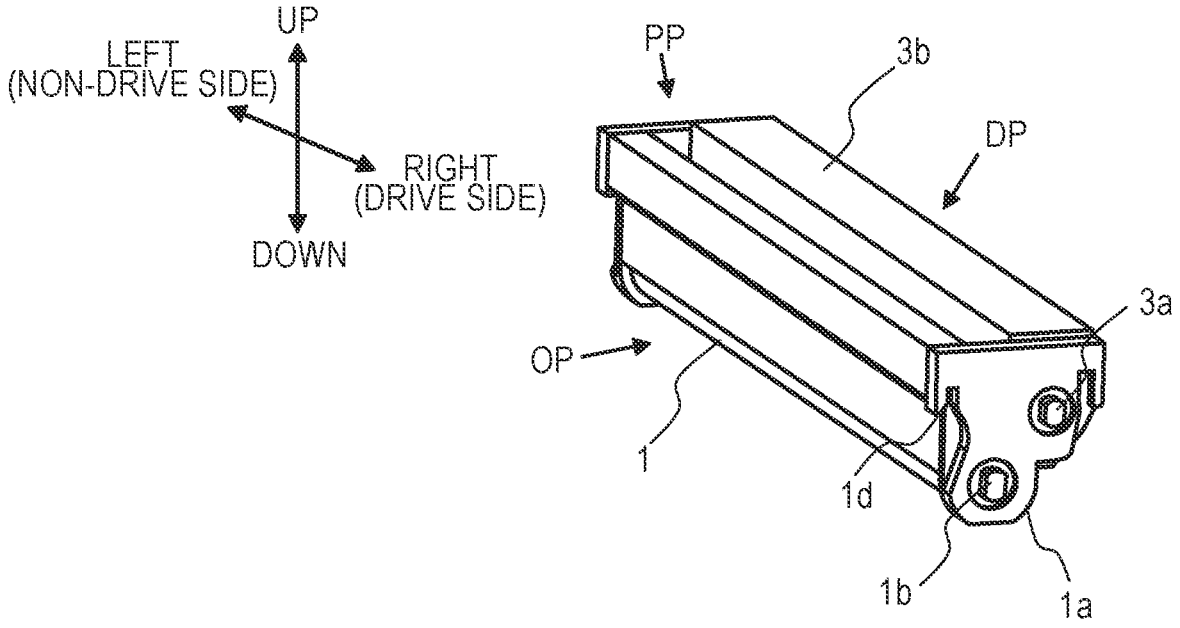
FIG. 2A and FIG. 2B are perspective views of a cartridge of the image forming apparatus of the first embodiment.

The process cartridge PP will be described with reference to FIG. 2A and FIG. 2B. The mounting position of the process cartridge PP is a position in which the image forming operation is possible. The process cartridge PP contributes to an image forming process for forming an image on the sheet S. The process cartridge PP is removably mounted and used in the image forming apparatus 100. As shown in FIG. 2A and FIG. 2B, each process cartridge PP in the first embodiment comprises a drum unit OP having a photosensitive drum 1 on which an electrostatic latent image is formed, and a developing unit DP acting on the photosensitive drum 1 as an electrophotographic image forming process unit. The drum unit OP has a photosensitive drum 1 and a charging roller 2 (FIG. 1A and FIG. 1B) configured to charge the surface of the photosensitive drum 1. A drum coupling 1*b* is provided on the drive side of the photosensitive drum 1 in the rotation axial direction of the photosensitive drum 1. The drum unit OP has drum flanges 1*a* and groove portions 1*d* at both ends. The developing unit DP has a developing device 4. The developing device 4 has the developing roller 3 as the toner carrying member configured to developing the electrostatic latent image into a toner image by supplying toner to the photosensitive drum 1, and a toner containing portion 3*b* configured to contain toner. A developing coupling 3*a* is provided on the drive side of the developing roller 3.

The color of the contained toner is different in each process cartridge PP. That is, in the first process cartridge PPY, yellow (Y) color toner is contained in the toner containing portion 3*b*, and a yellow toner image is formed on the surface of the photosensitive drum 1. Thereafter, the toner of magenta (M) color is contained in the second process cartridge PPM, the toner of cyan (C) color is contained in the third process cartridge PPC, and the toner of black (K) color is contained in the fourth process cartridge PPK, and toner images of each color are formed.

The description returns to FIG. 1B. Below the process cartridge PP, the primary transfer roller 17 as a transfer member is arranged opposite to the photosensitive drum 1 of each drum unit OP. A transfer voltage is applied to the primary transfer roller 17 from the primary transfer voltage application unit 73, and the toner image formed on the surface of the photosensitive drum 1 is primarily transferred on the surface of the intermediate transfer belt 13 of the intermediate transfer unit 12. As shown in FIG. 1B, the intermediate transfer unit 12 includes the intermediate transfer belt 13 which is a flexible endless belt, a drive roller 14 which tenses the intermediate transfer belt 13 and circulates and moves the intermediate transfer belt 13, an auxiliary roller 15, and a tension roller 16. The drive roller 14 and the auxiliary roller 15 are disposed on the back side in the image forming apparatus 100. The tension roller 16 is disposed on the front side of the image forming apparatus 100.

In a state in which each of the process cartridges PP is mounted at the predetermined mounting position, the lower surface of the photosensitive drum 1 is in contact with the intermediate transfer belt 13. The primary transfer roller 17 is disposed inside the intermediate transfer belt 13 so as to face the photosensitive drum 1. A nip portion which is a contact portion between the photosensitive drum 1 and the intermediate transfer belt 13 is referred to as a primary transfer nip portion T1. The secondary transfer roller 27 is brought into contact with the drive roller 14 via the intermediate transfer belt 13. A nip portion between the secondary transfer roller 27 and the intermediate transfer belt 13 is referred to as a secondary transfer nip portion T2. A light guide 57 is arranged in a lower portion of the cartridge tray 40. The cleaning unit 26 is arranged on the intermediate transfer belt 13 and cleans the intermediate transfer belt 13.

A feeding unit 18 configured to contain sheets S on which toner images are transferred and feed the sheets S one by one to the intermediate transfer unit 12 is arranged below the intermediate transfer unit 12. The feeding unit 18 has a sheet feed tray 19 in which the sheets S are stacked and contained, sheet feed rollers 20, an inner plate 21, and a pair of registration rollers 22. The sheet feed tray 19 can be freely pushed in and pulled out (inserted and extracted) from the front side of the image forming apparatus 100 (front loading).

The fixing unit 23 configured to heat and press the sheet S on which the toner image has been transferred to fix the image to the sheet S and a pair of discharge rollers 24 are arranged on an upper portion of the back side in the image forming apparatus 100. The fixing unit 23 includes a fixing film assembly 23*a* and a pressure roller 23*b*. A nip portion between the fixing film assembly 23*a* and the pressure roller 23*b* is referred to as a fixing nip portion Q. The pair of discharge rollers 24 has a discharge roller 24*a* and a roller 24*b*. A discharge tray 25 is formed on an upper surface of a main body of the image forming apparatus 100.

The front door 31 rotatably attached to the image forming apparatus 100 is disposed on the front side of the image forming apparatus 100. By opening the front door 31, a user can access the cartridge tray 40, and by pulling out the cartridge tray 40 toward the user, the process cartridges PP can be replaced. That is, each process cartridge PP can be inserted into and removed from the image forming apparatus 100. The image forming apparatus to which the present disclosure is applied is not limited to the image forming apparatus 100 shown in FIG. 1B, and may be, for example, an image forming apparatus having a conveying belt configured to convey the sheet S or an image forming apparatus having one process cartridge.

[2. Control Mode of Image Forming Apparatus]

FIG. 3 is a block diagram showing a schematic control mode of a main part of the image forming apparatus 100 in the first embodiment. The control unit 200 controls the operation of the image forming apparatus 100. The control unit 200 transmits and receives various kinds of electrical information signals. The control unit 200 also performs the processing of electrical information signals input from various process devices and sensors, and the processing of command signals to various process devices. The controller 400 sends and receives various kinds of electrical information to and from the host apparatus, and integrally controls the image forming operation of the image forming apparatus 100 by the control unit 200 via an interface portion 300 according to a predetermined control program and a reference table. The control unit 200 includes a CPU 155 as a central element configured to perform various arithmetic operations, a RAM as a storage element, a memory 30 such as a ROM, and the like. The RAM stores the detection result of the sensors, the count result of the counter, the calculation result, etc., and the ROM stores a control program, a data table obtained in advance by an experiment, etc.

The control unit 200 is connected to objects to be controlled, sensors, counters and the like in the image forming apparatus 100. The control unit 200 controls the transmission and reception of various kinds of electrical information signals and the timing of the driving of each portion to control a predetermined image forming sequence. For example, in order to form the toner image on the surface of the photosensitive drum 1, the control unit 200 controls high-voltage power sources and devices described below. The control unit 200 controls the charging voltage application unit 71 as a charging power source, the developing voltage application unit 72 as a developing power source, and the exposure unit 11. Further, the control unit 200 controls the primary transfer voltage application unit 73 as a primary transfer power source and a secondary transfer voltage application unit 74 as a secondary transfer power source in order to form the toner image on the sheet S. In addition, the control unit 200 controls a drive unit 70 configured to rotate various rollers, a pre-exposure unit 55 as a charge elimination unit configured to eliminate the charge on the surface of the photosensitive drum 1, a development and separation mechanism 50 configured to control the contact/separation between the photosensitive drum 1 and the developing roller 3, and the fixing unit 23. Specific configuration of the pre-exposure unit 55 will be described later in detail.

[3. Image Forming Operation]

Next, an operation for forming the full-color image will be described with reference to FIG. 1B, FIG. 2A and FIG. 3. Initially, when the control unit 200 receives a job signal from the interface portion 300, the control unit 200 moves the development and separation mechanism 50 in the front-back direction of the image forming apparatus 100. As shown in FIG. 2A, in the process cartridge PP, the developing coupling 3*a* is provided on the drive side of the developing roller 3, and the developing unit DP is rotatably supported around the developing coupling 3*a*. The developing roller 3 and the photosensitive drum 1 abut on each other when the developing unit DP is rotated by the development and separation mechanism 50. Further, the monochrome image forming operation and the full-color image forming operation are different in operation, and in the monochrome image forming operation, the development and separation mechanism 50 operates so that only the fourth developing roller 3K and the fourth photosensitive drum 1K abut against each other.

The photosensitive drum 1Y of the first process cartridge PPY, the photosensitive drum 1M of the second process cartridge PPM, the photosensitive drum 1C of the third process cartridge PPC, and the photosensitive drum 1K of the fourth process cartridge PPK are rotated at a predetermined speed in the counterclockwise direction in FIG. 1B. The intermediate transfer belt 13 is driven to rotate clockwise at a speed corresponding to the speed of the photosensitive drum 1. In synchronization with this drive, the charging roller 2 uniformly charges the surface of the photosensitive drum 1 to the predetermined potential of the predetermined polarity at a predetermined timing in each of the process cartridges PP. In the first embodiment, the predetermined polarity (normal polarity) is defined as a negative polarity. Therefore, the normal polarity of the toner is the negative polarity.

Next, the exposure unit 11 exposes the surface of the photosensitive drum 1 by irradiating the surface of the photosensitive drum 1 with light from a light source according to image signals of respective colors. Thus, an electrostatic latent image corresponding to the image signal of the corresponding color is formed on the surface of the photosensitive drum 1. The electrostatic latent image is developed into a toner image by the developing roller 3. By the image forming operation, a yellow toner image corresponding to the Y color component of the full color image is formed on the photosensitive drum 1Y of the first station. The toner image is primarily transferred onto the intermediate transfer belt 13 at the primary transfer nip portion T1. Thereafter, in the same manner as in the first station, the magenta, cyan, and black toner images at the second, third, and fourth stations are sequentially primarily transferred onto the intermediate transfer belt 13 at the primary transfer nip portions T1. In this way, on the surface of the intermediate transfer belt 13, the four color toner images are superimposed and transferred to form an unfixed full-color toner image.

The toner remaining on the surface of the photosensitive drum 1 without being primarily transferred onto the intermediate transfer belt 13 in the primary transfer nip portion T1 is collected by a cleaning device (not shown) which is a cleaning unit abutting on the photosensitive drum 1. On the other hand, the sheet feed rollers 20 are driven at a predetermined timing. Thus, the sheet feed rollers 20 and the inner plate 21 cooperate to separate and feed one sheet S stacked on the sheet feed tray 19, and the sheet S is introduced into the secondary transfer nip portion T2 by the pair of registration rollers 22 at a predetermined timing. At this time, in the process in which the sheet S is conveyed while being nipped by the secondary transfer nip portion T2, the toner images of four colors superimposed on the intermediate transfer belt 13 are collectively transferred to the surface of the sheet S. The sheet S is separated from the surface of the intermediate transfer belt 13, conveyed along a conveying path, and introduced into the fixing unit 23. The unfixed toner image transferred onto the sheet S is heated and pressurized by the fixing unit 23 at the fixing nip portion Q and fixed to the sheet S.

The sheet S passes through the fixing unit 23 and is discharged onto the discharge tray 25 by the pair of discharge rollers 24 as a full-color image-formed matter. The toner (secondary transfer residual toner) remaining on the surface of the intermediate transfer belt 13 after the sheet S is separated is removed by a cleaning unit 26 arranged on the intermediate transfer belt 13. When the image forming operation (job) is completed, the development and separation mechanism 50 is operated so that the photosensitive drum 1 of the drum unit OP and the developing roller 3 of the developing unit DP are separated from each other, and the driving of the various voltage application units is stopped, thereby completing the image formation.

[4. Drum Ghost]

The surface potential formed on the surface of the photosensitive drum 1 is changed through the image forming process. In particular, the surface potential of the photosensitive drum 1 is changed by the latent image process, the charging process, and the transfer process. The surface potential formed on the photosensitive drum 1 is affected by the magnitude of electric discharge in the process involving the electric discharge, such as the charging process and the transfer process, as described above, and by the surface potential formed on the photosensitive drum 1 before receiving the electric discharge. More specifically, in order to form the image on the sheet S, when an image forming area (bright section potential: V1 region) in which a toner image is formed and a non-image forming area (dark section potential: Vd region) in which no toner image is formed are formed on the surface of the photosensitive drum 1, a difference occurs in the surface states of both areas after transfer. If the electric discharge is generated by the charging roller 2 in the state, a difference may occur in the surface potential after charging. Since the transfer voltage applied to the primary transfer roller 17 during image formation has a positive polarity that is opposite in polarity to the surface potential formed on the photosensitive drum 1, a positive residual charge is generated on the surface of the photosensitive drum 1. The quantity of the positive residual charge varies depending on the surface potential of the photosensitive drum 1. For this reason, even if the same surface potential can be formed in an area which is the image forming area and an area which is the non-image forming area by the electric discharge due to charging, an absolute value of the surface potential may decrease due to the influence of the residual charge when the latent image process or the developing process is performed after a lapse of time.

When a toner image is once formed on an outer peripheral surface of the photosensitive drum 1, the potential at which the toner image is formed remains on the outer peripheral surface of the photosensitive drum 1 after the toner image is transferred. For this reason, there is a case in which an afterimage (ghost image) of the previously formed toner image is generated as a history in a next image formed on the outer peripheral surface of the photosensitive drum 1. This phenomenon is called drum ghost. Specifically, the potential difference between the image forming area and the non-image forming area of the history image remaining on the outer peripheral surface of the photosensitive drum 1 after the image formation in the first revolution of the photosensitive drum remains even in the image formation in the second revolution, and the density of the history image appears on the image in the second revolution output on the sheet S.

The process of generating drum ghosts is considered to be as follows. Each of the processes of charging, latent image, development and transfer when the photosensitive drum 1 rotates one revolution is defined as an image forming process of one cycle. In this case, a potential difference remains on the surface of the photosensitive drum 1 after the completion of the image forming process of the first cycle. The potential difference in the first cycle does not completely disappear even when the surface of the photosensitive drum 1 is uniformly charged by the charging roller 2 in the second cycle. As a result, the surface of the photosensitive drum 1 is not uniformly charged, and the potential difference remaining after the charging may not disappear even after exposure. Therefore, the electrostatic latent image after exposure of the photosensitive drum 1 in the second cycle is not uniform in potential because the influence of the potential difference in the first cycle remains. In a case in which the electrostatic latent image on the outer peripheral surface of the photosensitive drum 1 in the second cycle is developed, the quantity of toner adhering to the non-image forming area varies depending on the remaining potential difference in the first cycle. That is, in the toner image of the second cycle which should be uniform, a portion having a large quantity of toner and a portion having a small quantity of toner are generated due to the influence of the potential difference of the electrostatic latent image of the first cycle. Accordingly, the toner image transferred to the intermediate transfer belt 13 is also shaded due to the difference in the quantity of toner, and the image eventually formed on the sheet S is also shaded in the dark portion and the light portion. The mechanism of the drum ghost will be specifically described later.

(Pre-Exposure Unit)

Therefore, in the first embodiment, the pre-exposure unit 55, which is an irradiation unit to be described later, is arranged in order to cancel the potential difference generated in the photosensitive drum 1 and suppress the generation of the drum ghost. The pre-exposure unit 55 serves to expose the surface of the photosensitive drum 1 before the photosensitive drum 1 passes through the primary transfer nip portion T1 and reaches the contact portion with the charging roller 2. Even if the states of charges on the surfaces in the image forming area and the non-image forming area of the photosensitive drum 1 are different, the charge is reset by the pre-exposure unit 55, and the charges are uniformly eliminated from the surface of the photosensitive drum 1. Since the charges are uniformly eliminated from the surface of the photosensitive drum 1, the potential of the photosensitive drum 1 is uniformly formed by the charging roller 2. Thus, the occurrence of the drum ghost generated in the photosensitive drum 1 can be suppressed.

(Drum Ghost and Mechanism of Drum Ghost Occurrence)

Figure 4A:
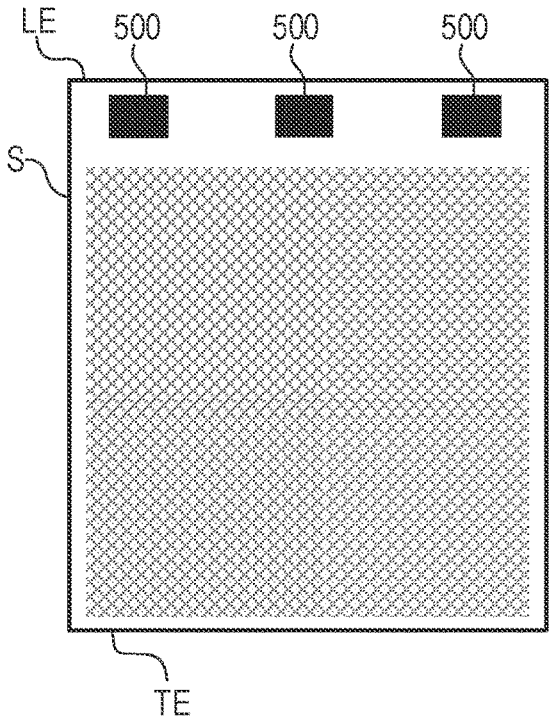
FIG. 4A is a view showing a solid black patch.
Figure 4B:
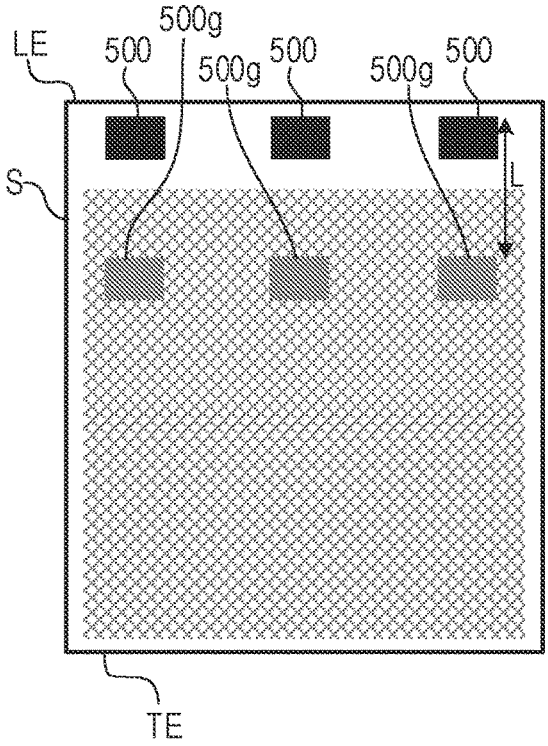
FIG. 4B is a view illustrating a mechanism by which drum ghosts occur.

An image formed in a case in which a drum ghost actually occurs will be described. Here, the length of the outer periphery of the photosensitive drum 1 is defined as L. FIG. 4A is a view showing an image (which would be output if there were no drum ghosts) to be formed on the sheet S. FIG. 4B is a view showing an image formed on the sheet S in a case in which drum ghosts occur. When the photosensitive drum 1 is set in the image forming apparatus 100 and an image as shown in FIG. 4A is output in a state in which the surface potential of the photosensitive drum 1 is adjusted, an image defect as shown in FIG. 4B may occur. As shown in FIG. 4A, a plurality of solid black patches 500 are formed on the side of a leading edge LE of the sheet S. In this case, as shown in FIG. 4B, a plurality of drum ghosts 500*g* are formed at a position of a distance L from leading edges of the plurality of solid black patches 500 toward the side of a trailing edge TE of the sheet S, and an image defect appears. The distance L corresponds to a circumferential length of the photosensitive drum 1. The plurality of drum ghosts 500*g* are formed after one revolution of the photosensitive drum 1. The image defect such as the drum ghosts 500*g* becomes remarkable especially in a hot and humid environment. More specifically, in a case in which portions where the solid black patches 500 are printed in the image forming area contributes to the image formation again, the phenomenon occurs in which the density changes without forming the predetermined surface potential on the photosensitive drum 1.

Figure 4C:
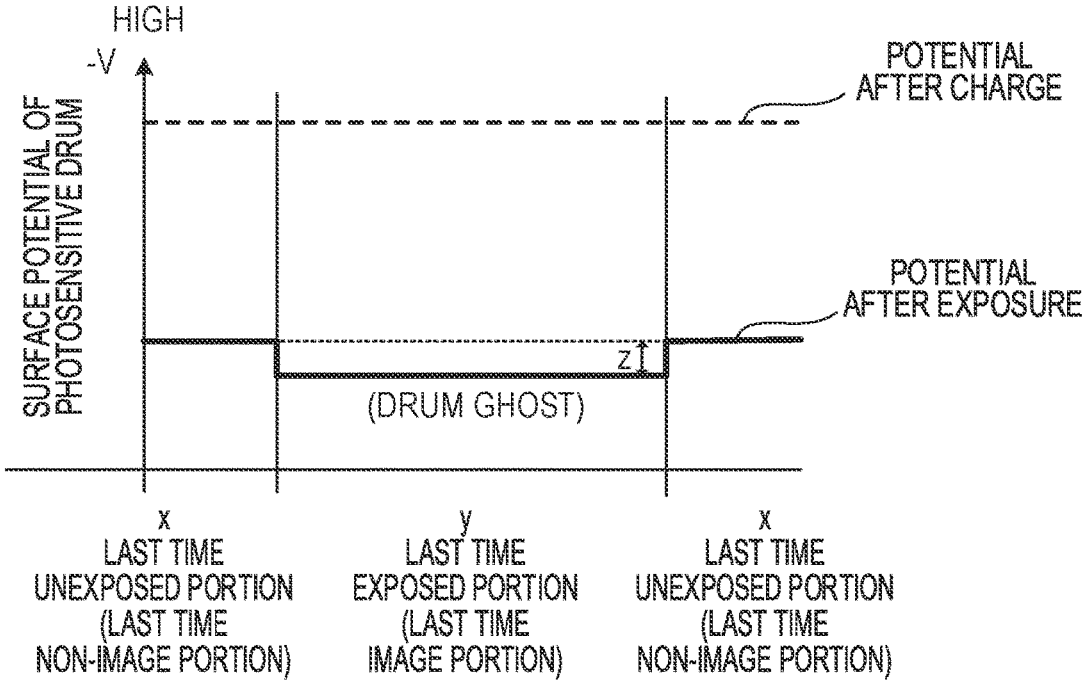
FIG. 4C is a view showing a relationship between a surface potential of a photosensitive drum and a position in a longitudinal direction.

The mechanism by which drum ghosts occur in an image will be described in detail below. As described above, a drum ghost may be generated from a potential difference when an exposed portion and an unexposed portion on the photosensitive drum 1 are charged in a next charging step. In the exposed portion in the previous step, a potential difference is generated in the next charging step due to the influence of residual charges or the like. This is shown in FIG. 4C. FIG. 4C shows the relationship between the surface potential of the photosensitive drum 1 and the position in the longitudinal direction. FIG. 4C shows the surface potential of the photosensitive drum 1 when the exposed portion (previously exposed portion (previous image portion)) and the unexposed portion (previously unexposed portion (previous non-image portion)) are recharged and reexposed in the rotation axial direction of the photosensitive drum 1. In FIG. 4C, the horizontal axis indicates the position of the photosensitive drum 1 in the longitudinal direction (rotation axial direction), and the vertical axis indicates the surface potential (−V) of the photosensitive drum 1. A broken line indicates a potential after charging, and a solid line indicates a potential after exposure.

As shown in FIG. 4C, when exposure is performed again in the exposure step, a difference ("z" in FIG. 4C) occurs in the potential after exposure between the exposed portion (previous image portion "y") in the previous step and the unexposed portion (previous non-image portion "x") in the previous step. That is, the potential difference between the previous image portion "y" exposed before one revolution of the photosensitive drum 1 and the previous non-image portion "x" not exposed before the one revolution of the photosensitive drum 1 remains on the photosensitive drum 1 even at the time of the next image formation. When the potential difference ("z" portion) becomes large, a drum ghost which is a density difference occurs in the eventually formed image.

[5. Relationship Between Process Cartridges and Cartridge Tray]

Figure 5A:
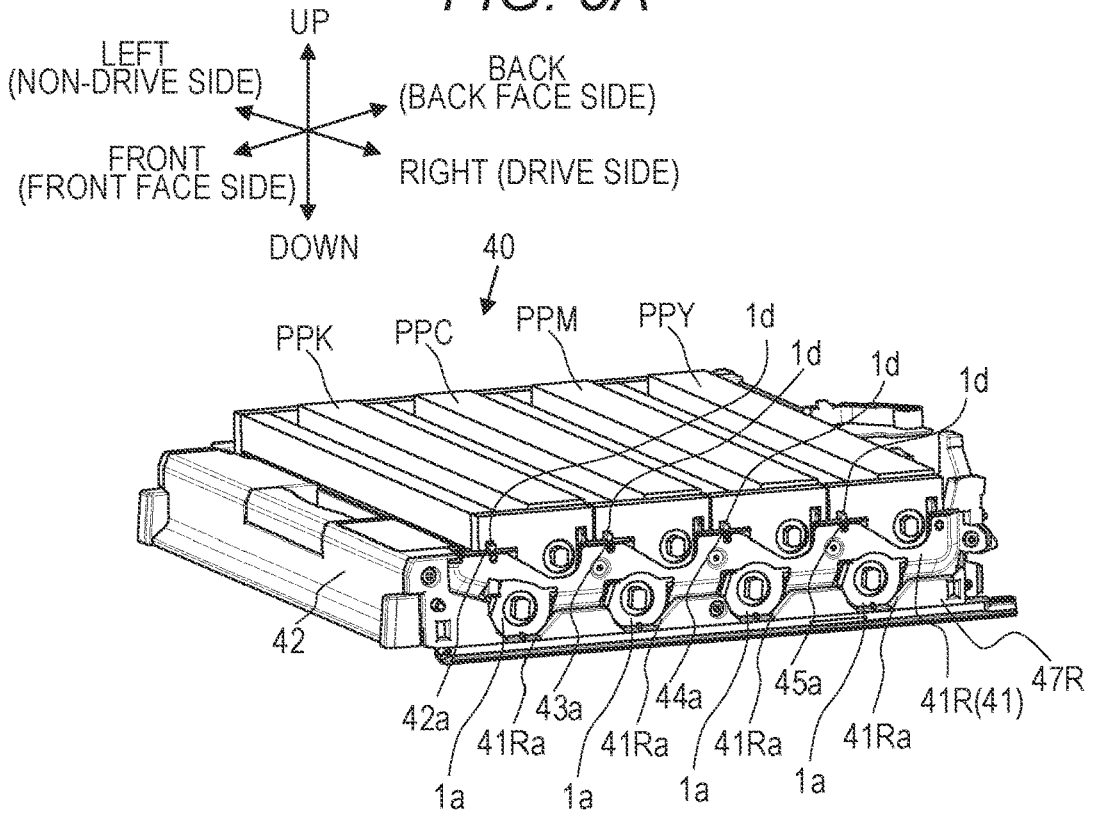
FIG. 5A is a perspective view from an upper right side of a cartridge tray.
Figure 5B:
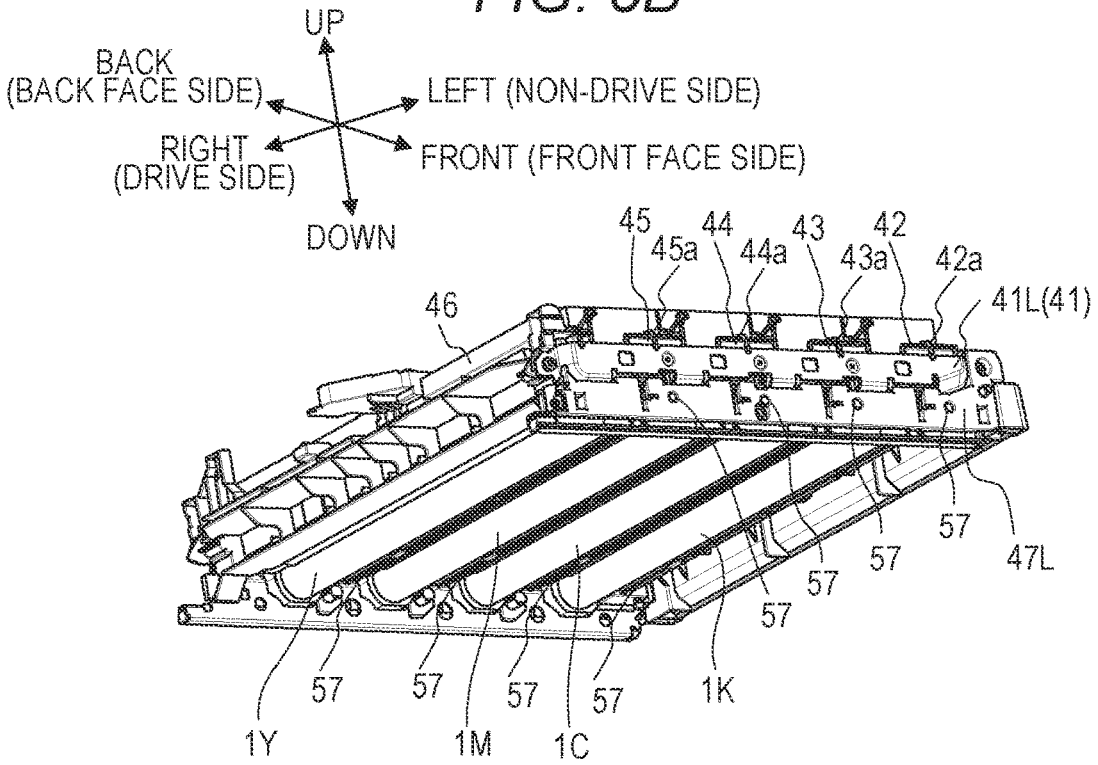
FIG. 5B is a perspective view from a lower left side of the cartridge tray.

Next, with reference to FIG. 2A, FIG. 2B, FIG. 5A and FIG. 5B, the cartridge tray 40 and the state in which the process cartridge PP is mounted to the cartridge tray 40 will be described. In FIG. 5A, the suffix letter R indicates a member on the right side (drive side). In FIG. 5B, the suffix letter L indicates a member on the left side (non-drive side). The cartridge tray 40 is a moving member configured to be moved between the internal position and the external position of the image forming apparatus 100 while holding the process cartridges PP, and facilitates the replacement of the process cartridges PP. The cartridge tray 40 is configured so that the process cartridges PP are detachably mounted to the cartridge tray 40.

FIG. 5A is a perspective view from the upper right side of the cartridge tray 40 to which the process cartridges PP are mounted. FIG. 5B is a perspective view from the lower left side of the cartridge tray 40 to which the process cartridges PP are mounted. Here, since the process cartridges PP are mounted in the same state in respective colors, one process cartridge PP will be described. The drum flange 1*a* is in contact with a cartridge engaging portion 41Ra of the cartridge tray 40 in a state in which the process cartridge PP is mounted to the cartridge tray 40. A force in the gravitational direction by its own weight or downward pressure is applied to the process cartridge PP so that the process cartridge PP is positioned with respect to the cartridge tray 40. The cartridge engaging portion 41Ra of the cartridge tray 40 is formed into, for example, a V-shape, and is designed to have optimum angles so that the process cartridge PP does not move during image formation. Specifically, with respect to the pull out direction of the cartridge tray 40, a slope on the front side is 65° and a slope on the back side is 45°. Further, the groove portion 1*d* of the process cartridge PP is fitted onto the engaging boss 42*a* (43*a*, 44*a*, 45*a*) of the cartridge tray 40, and serves to prevent rotation of the process cartridge PP. Specifically, the groove portion 1*d* of the process cartridge PPK is fitted onto the engaging boss 42*a* of the cartridge tray 40. The groove portion 1*d* of the process cartridge PPC is fitted onto the engaging boss 43*a* of the cartridge tray 40. The groove portion 1*d* of the process cartridge PPM is fitted onto the engaging boss 44*a* of the cartridge tray 40. The groove portion 1*d* of the process cartridge PPY is fitted onto the engaging boss 45*a* of the cartridge tray 40. Although these are descriptions of the drive side of the cartridge tray 40, the process cartridge PP is also brought into contact with the cartridge tray 40 on the non-drive side so that the posture of the process cartridge PP is maintained. The cartridge tray 40 is positioned in the image forming apparatus 100 while holding the process cartridges PP.

The cartridge tray 40 has a pair of metal tray side plates 41R and 41L having the cartridge engaging portions 41Ra and 41La (not shown), respectively, corresponding to the respective process cartridges PP. The cartridge tray 40 includes five resin connecting members provided between the pair of tray side plates 41L and 41R. The connecting members include a first connecting member 42 having the engaging boss 42*a* configured to engage with the process cartridge PPK of the fourth station. Hereinafter, the connecting members include, in order from the front side, a second connecting member 43 having the engaging boss 43*a* of the third station, a third connecting member 44 having the engaging boss 44*a* of the second station, a fourth connecting member 45 having the engaging boss 45*a* of the first station, and a fifth connecting member 46. The second connecting member 43, the third connecting member 44, and the fourth connecting member 45 have the same shape. The tray side plates 41 (41L, 41R) have a shape in which an upper portion is drawn outward compared with a lower portion. Between the tray side plates 41L and 41R, the upper portion is wide, a middle portion has a slope, and the lower portion is narrow. The lower portions of the tray side plates 41L and 41R are provided with positioning portions between the cartridge engaging portions 41Ra of the cartridge tray 40 and the connecting members The upper portions of the tray side plates 41L and 41R serve to stop the rotations of the first connecting member 42 to the fourth connecting member 45 near the engaging bosses 42*a* to 45*a*. With such a configuration, the width of the cartridge tray 40 in the left-right direction can be reduced without impairing the insertability and removability of the process cartridge PP, thereby contributing to the miniaturization of the image forming apparatus 100. The lower sides of the tray side plates 41L and 41R are bent in an L-shape to ensure the strength. The tray side plates 41L and 41R are fastened to the respective connecting members by screws. However, the embodiment is not limited to the screws. The embodiment may use thermal caulking or the like. The first connecting member 42 and the fifth connecting member 46 may be fastened to the tray side plates 41L and 41R, and the second connecting member 43, the third connecting member 44 and the fourth connecting member 45 therebetween may not be fastened.

[6. Pre-Exposure Unit]

Next, the pre-exposure unit 55 as the charge elimination unit in the first embodiment will be described. As shown in FIG. 5B, four light guides 57 (guides) are provided in the lower portion of the cartridge tray 40 and are provided in the first connecting member 42, the second connecting member 43, the third connecting member 44, and the fourth connecting member 45 so as to penetrate the tray guide member 47L. A tray guide member 47R is provided on the drive side. In the first embodiment, the cylindrical light guides 57 having a diameter of 4 mm are used.

Figure 6:
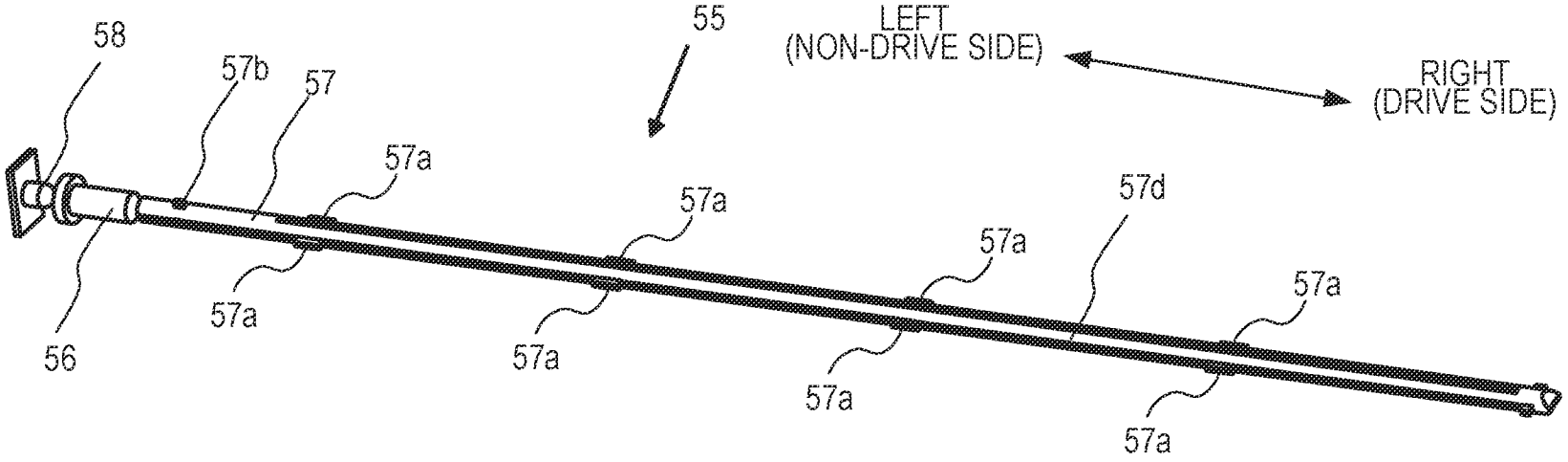
FIG. 6 is a perspective view of a light guide of the first embodiment.

FIG. 6 is a view showing the configuration of the pre-exposure unit 55. The pre-exposure unit 55 has a light emitting portion 58 which is a light source, and the light guide 57 in which the light emitting portion 58 is provided at one end (non-drive side) and guides the light emitted from the light emitting portion 58 in the rotation axial direction of the photosensitive drum 1. The pre-exposure unit 55 irradiates the photosensitive drum 1 with the light after the toner image is transferred to the intermediate transfer belt 13 by the primary transfer roller 17. The light guide 57 has a plurality of tabs 57*a* for striking the ejector pins during molding. The plurality of tabs 57*a* also serves to position the light guide with respect to the cartridge tray 40 and prevent the light guide 57 from being reversely attached thereto. The light guide 57 has a rib 57*b* including an inclined surface so that the phase in the rotation direction can be determined when the light guide 57 is attached to the cartridge tray 40. Light emitted by the light emitting portion 58 which is a light emitting unit such as an LED provided on the non-drive side of the image forming apparatus 100 enters the light guide 57 through a sub-light guide 56 provided on the main body side. Light is uniformly dispersed by a Fresnel portion 57*d* having a Fresnel shape formed inside the light guide 57. By irradiating the surface of the photosensitive drum 1 with the light dispersed by the Fresnel portion 57*d*, the surface potential formed on the surface of the photosensitive drum 1 before being charged by the charging roller 2 is discharged to a predetermined surface potential, and the surface potential is stabilized.

The Fresnel portion 57*d* has a shape in which shallow mountain shapes having an apex angle of about 114 degrees continue at a pitch of about 0.7 mm while being inclined by 80 degrees with respect to the rotation axial direction of the photosensitive drum 1, and are arranged on a surface opposite to a position facing the photosensitive drum 1. In a state in which the process cartridge PP is positioned in the cartridge tray 40, a clearance between a surface of the light guide 57 and the surface of the photosensitive drum 1 is approximately 5.6 mm. The light guide 57 is formed of a transparent material such as acrylic resin, but any transparent material may be used. Although a light input side is the non-drive side in the first embodiment, the light input side may be the drive side. In a case in which the light quantity is insufficient, light emitting portions 58 may be provided at both ends. The light emitting portion 58 is not limited to an LED, but may be an element such as a laser diode.

The light quantity in the light guide 57 is strongest on the light input side. As the light is dispersed by the Fresnel portion 57*d* toward the other end of the non-input side opposite to the light input side, and is irradiated onto the photosensitive drum 1, the light becomes weaker as closer to the other end. Therefore, in order to uniformly irradiate light in the longitudinal direction, the width of the Fresnel portion 57*d* is different between the light input side and the opposite side of the light guide 57. In the first embodiment, the width of the Fresnel portion 57*d* is changed from about 0.8 mm on the light input side to about 1.7 mm on the opposite side.

However, it is difficult for the thick light guide 57 to completely prevent air bubbles generated during molding. If the light in the light guide 57 hits the air bubbles, a diffused reflection occurs. In particular, on the light input side in which the light quantity is high, the light is liable to be affected by the diffused reflection due to bubbles, and the quantity of light to be irradiated is partially increased to cause the charge elimination unevenness. In order to address this issue, the first embodiment has the following structure. That is, each of the first connecting member 42, the second connecting member 43, the third connecting member 44, and the fourth connecting member 45 configured to hold the light guide 57 is provided with a blocking member 48 (FIG. 7A) configured to reduce the light emitted from the light guide 57. The blocking member 48 reduces the irradiation light quantity at a portion in which the charge elimination quantity is partially increased. That is, the blocking member 48 serves as a shielding member configured to shield the photosensitive drum 1 from the irradiation light so that the irradiation light quantity is reduced at the portion in which the charge elimination quantity is partially increased. The blocking member 48 is provided on the cartridge tray 40. In the first embodiment, the blocking member 48 is integrated with each of the first connecting member 42, the second connecting member 43, the third connecting member 44, and the fourth connecting member 45. However, the blocking member 48 may be a separate member from each of them.

(Blocking Member)

Figure 7A:
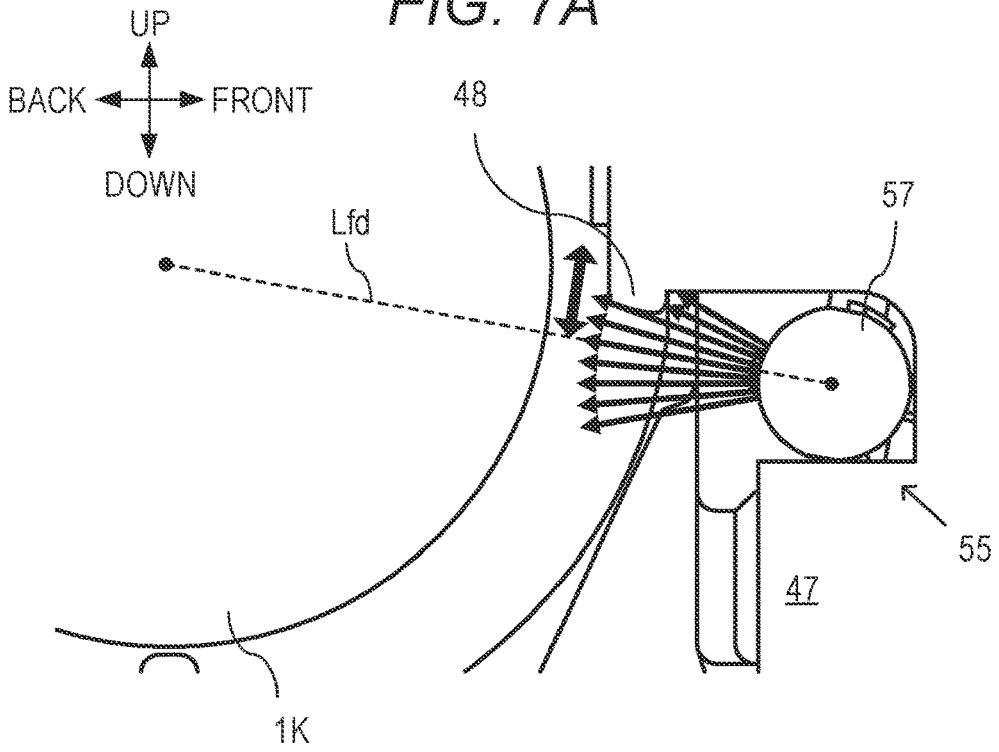
FIG. 7A and FIG. 7B are enlarged views of a blocking member of the first embodiment.
Figure 7B:
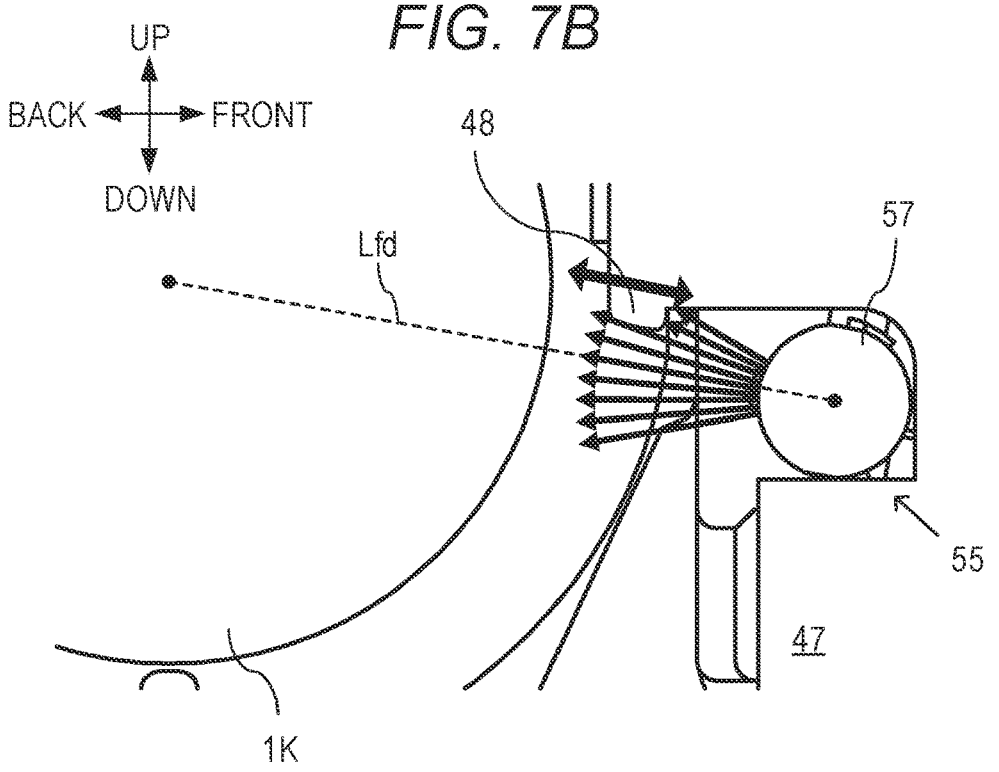

FIG. 7A and FIG. 7B are views showing the blocking member 48 provided on the first connecting member 42 of the fourth station. In FIGS. 7A and 7B, the configuration of the fourth station is shown, but the other first to third stations have the same configuration. The blocking member 48 is formed of a material that does not transmit light, and is configured to irradiate the photosensitive drum 1 with light from a portion in which the blocking member 48 is not provided. That is, by changing the shape of the blocking member 48, the quantity of blocking the irradiation light to the photosensitive drum 1 can be adjusted. In other words, depending on the shape of the blocking member 48, the quantity of blocking the light irradiated from the pre-exposure unit 55 can be changed in the rotation axial direction of the photosensitive drum 1. In the first embodiment, the blocking member 48 is extended in a vertical direction (an orthogonal direction as indicated by the two-headed arrow in FIG. 7A), which is the first direction, perpendicular to an imaginary line Lfd (hereinafter referred to as line Lfd) connecting a center of the Fresnel portion 57*d* and a center of the photosensitive drum 1, thereby adjusting the irradiation light quantity. That is, in the vertical direction orthogonal to the line Lfd connecting the light guide 57 and the photosensitive drum 1, a length of the blocking member 48 extending toward the line Lfd is longer as closer to the light emitting portion 58. Further, as shown in FIG. 7B, the blocking member 48 may adjust the quantity of blocking the irradiation light by changing a length (thickness) in a horizontal direction (a direction as indicated by the two-headed arrow in FIG. 7B) which is the second direction parallel to the line Lfd. That is, in the horizontal direction parallel to the line Lfd, the length of the blocking member 48 may be made longer as closer to the light emitting portion 58. Further, the light quantity of the irradiation light may be adjusted by changing the length in the vertical direction and the length in the horizontal direction with respect to the line Lfd. As described above, the blocking member 48 is provided in such a manner that the decrease in the light quantity is different between the light input side and the other end side opposite to the light input side with respect to the central portion of the photosensitive drum 1 in the rotation axial direction. Specifically, the closer the blocking member 48 is to the light emitting portion 58 in the rotation axial direction of the photosensitive drum 1, the greater the quantity of blocking the light irradiated from the pre-exposure unit 55.

First Embodiment and Comparative Example

Figure 8:
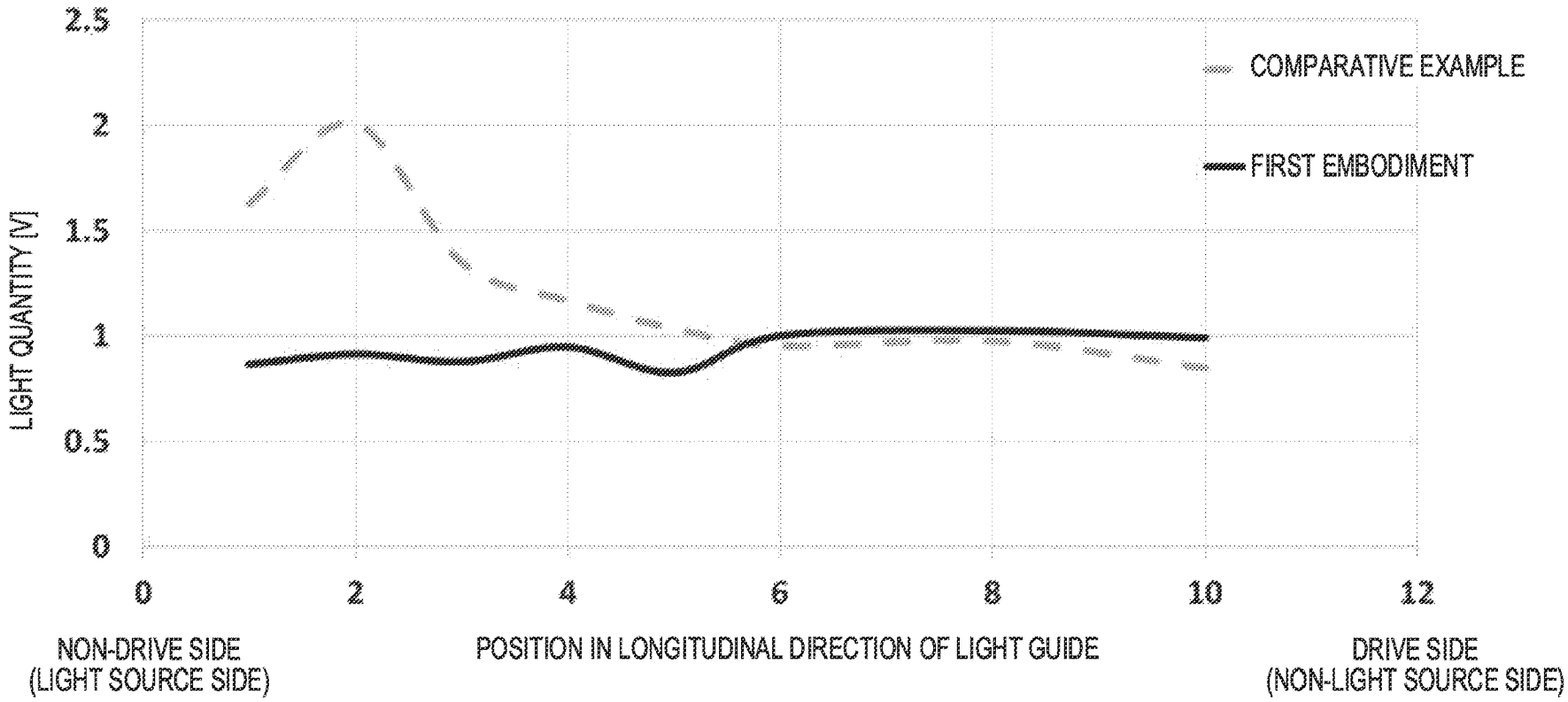
FIG. 8 is a graph showing light quantity distributions of the first embodiment and a comparative example in the longitudinal direction.

FIG. 8 is a graph showing the light quantity of the light irradiated onto the photosensitive drum 1 measured using a light quantity measuring tool. In FIG. 8, the horizontal axis indicates a position of the light guide 57 in the longitudinal direction, where "0" is the non-drive side (a light source side, the one end) and the position is closer to the drive side (a non-light source side and the other end) as going to the right. The vertical axis indicates the light quantity [V] of the light irradiated on the photosensitive drum 1. The light quantity of the light irradiated from the light emitting portion 58 through the light guide 57 onto the photosensitive drum 1 was measured by using the light quantity measuring tool, and the light quantity change in the longitudinal direction was compared. The light quantity measuring tool converts the light into a voltage using an Si photodiode S6775 (manufactured by Hamamatsu Photonics) in a light receiving portion, the voltage is evaluated. A comparative example shows the irradiation light quantity in a case in which the first embodiment is not used (a case in which the blocking member 48 is not provided), and the first embodiment shows the irradiation light quantity in a case in which the blocking member 48 is provided. In the comparative example (broken line), the irradiation light quantity in the range of about ⅓ on the light source side is high, and in some places, the irradiation light quantity is about twice as high as that on the other end (non-light source side). On the other hand, in the first embodiment (solid line), the light quantity is substantially constant in the longitudinal direction of the light guide 57.

Figure 9A:
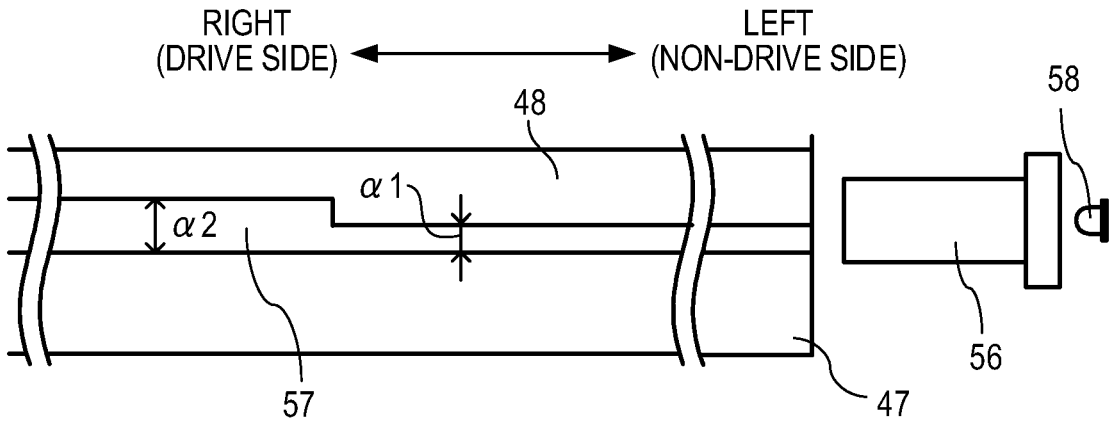
FIG. 9A, FIG. 9B, and FIG. 9C are views showing changes in an extension of the blocking member in the longitudinal direction of the first embodiment.
Figure 9B:
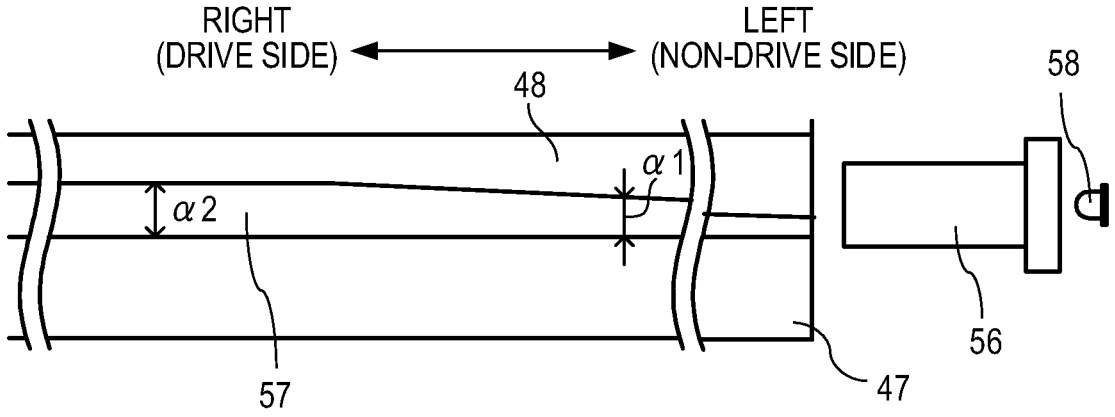
Figure 9C:
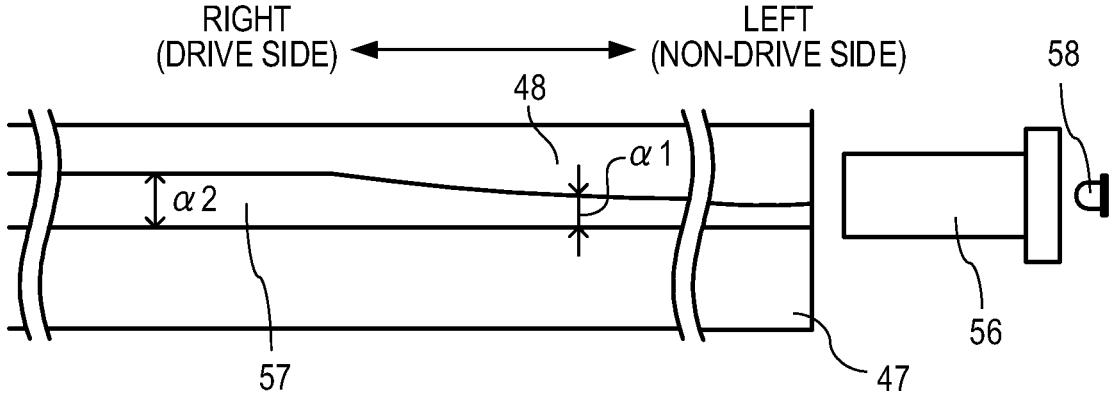

Here, a specific configuration of the blocking member 48 of the first embodiment will be described. FIG. 9A, FIG. 9B, and FIG. 9C are views showing the light guide 57 and the blocking member 48 as looking from the side of the photosensitive drum 1. FIG. 9A is a view showing the configuration of the light guide 57 of the first embodiment of FIG. 8. In the first embodiment, as shown in FIG. 9A, the blocking member 48 extends so that a distance $\alpha 1$ in the direction perpendicular to the line Lfd is 1 mm on the light input side on which the light emitting portion 58 is provided, thereby reducing the irradiation light quantity. On the other hand, in the blocking member 48, the distance $\alpha 2$ is set to be 1.3 mm for the other range where the influence of blocking becomes low. For example, in a case in which the blocking member 48 is divided into three regions (divided into three) in the rotation axial direction of the photosensitive drum 1, the blocking member 48 is configured so that the reduction in the light quantity in at least one region is different from the reduction in other regions. As described above, by providing the blocking member 48 in the first connecting member 42 with the degree of extension of the blocking member 48 varied in the longitudinal direction, the irradiation light quantity in the longitudinal direction can be made uniform. However, the present disclosure is not limited thereto. In a case in which the irradiation light quantity on the non-light source side is increased instead of the light source side, the distance between the line Lfd and the blocking member 48 on the non-light source side may be reduced.

Further, in the comparative example, the irradiation light quantity in the range of about ⅓ on the light input side is high and the irradiation light quantity in the other portion is uniform. Therefore, although the shape of the blocking member 48 has been changed in accordance with the shape of FIG. 9A, the present disclosure is not limited thereto. On the basis of the distribution of the irradiation light quantity in the longitudinal direction in a case in which the blocking member 48 is not present, the shape of the blocking member 48 may be changed, for example, in accordance with a shape as shown in FIG. 9B or FIG. 9C to make the light quantity uniform. Here, FIG. 9B and FIG. 9C are views showing other embodiments of the blocking member 48. More specifically, as shown in FIG. 9B and FIG. 9C, the blocking member 48 may be configured such that the distance between the line Lfd and the blocking member 48 is gradually increased from the light input side (light source side) to a predetermined position, and a constant distance is maintained from the predetermined position to the non-light source side. Further, as shown in FIG. 9B, the distance between the line Lfd and the blocking member 48 may be linearly increased, or as shown in FIG. 9C, the distance may be curved.

Figure 10A:
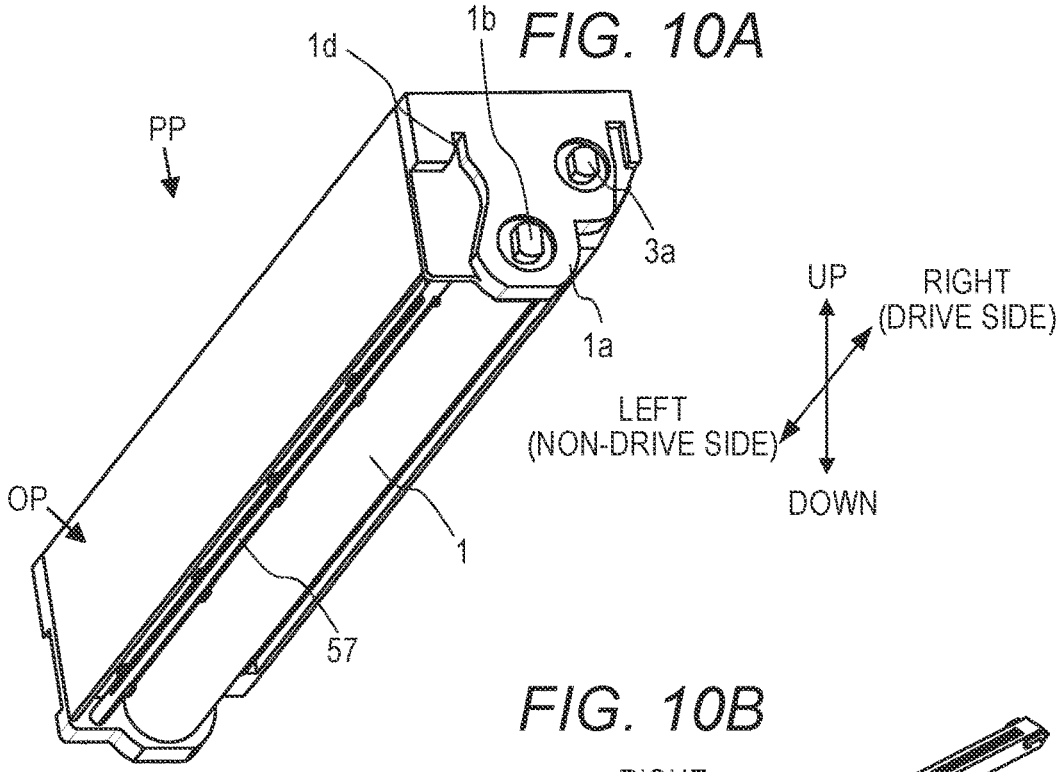
FIG. 10A is a perspective view of a process cartridge provided with a light guide.

The light guide 57 in the first embodiment is provided in the cartridge tray 40. However, the present disclosure is not limited thereto. FIG. 10A is a view showing another embodiment of a location where the light guide 57 is provided. For example, as shown in FIG. 10A, the light guide 57 may be provided in the process cartridge PP. Accordingly, a blocking member 48 may also be provided in the process cartridge PP.

Figure 10B:
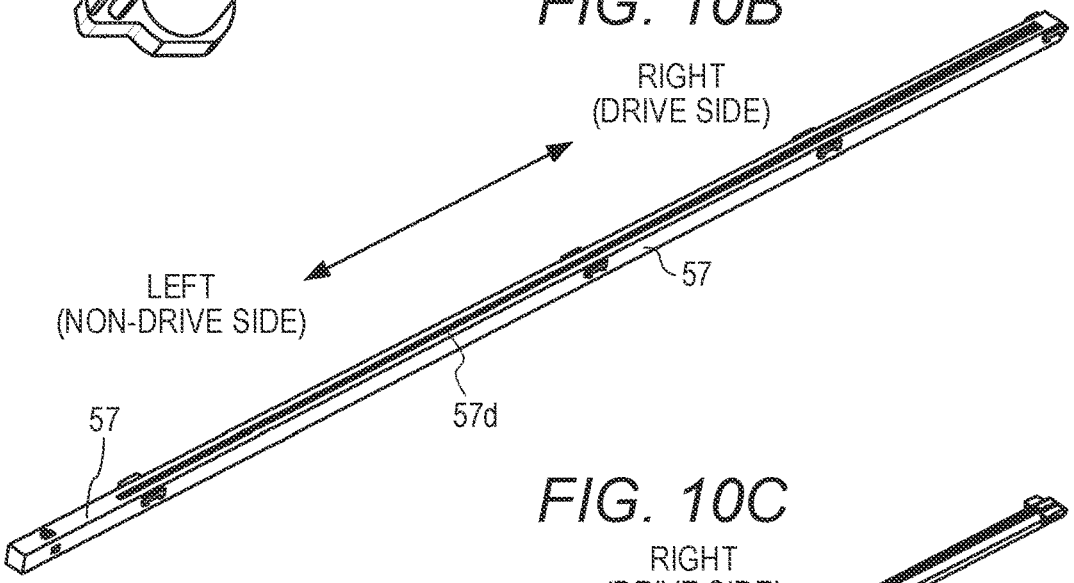
FIG. 10B and FIG. 10C are views illustrating light guides having other shapes, respectively.
Figure 10C:
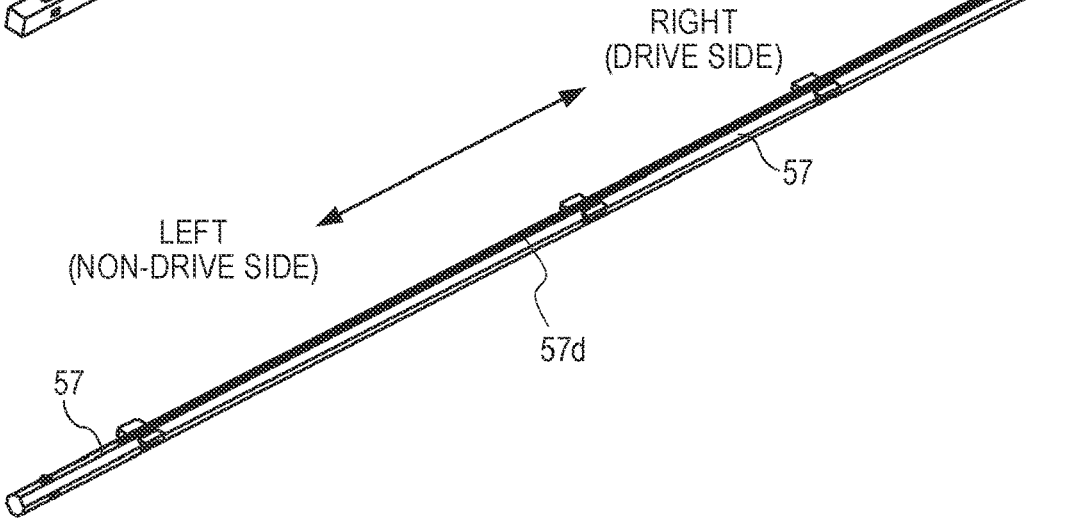

In the first embodiment, the light guide 57 has a cylindrical shape. However, the present disclosure is not limited thereto. FIG. 10B and FIG. 10C are views showing other embodiments of the shape of the light guide 57. For example, as shown in FIG. 10B, the light guide 57 may have a rectangular shape in the cross section perpendicular to the rotation axial direction of the photosensitive drum 1 and may have a quadrangular prism. As shown in FIG. 10C, the light guide 57 may have a polygonal shape in the cross section perpendicular to the rotation axial direction of the photosensitive drum 1 and may have a polygonal prism. In this way, the light guide 57 may have, for example, a circular shape, a rectangular shape, or a polygonal shape in the cross section perpendicular to the rotation axial direction of the photosensitive drum 1.

In the first embodiment, the light guide 57 has a flat end shape at both ends. However, the present disclosure is not limited thereto. Although a flat surface is preferable on the light input side, a triangular pyramid or a cone may be used on the non-light input side to make it easier for light to reflect so as to enhance the reflectance of the light input. A cap shaped blocking material configured to block the light may be provided at the end of the light guide 57 on the non-incident light side.

Figure 11A:
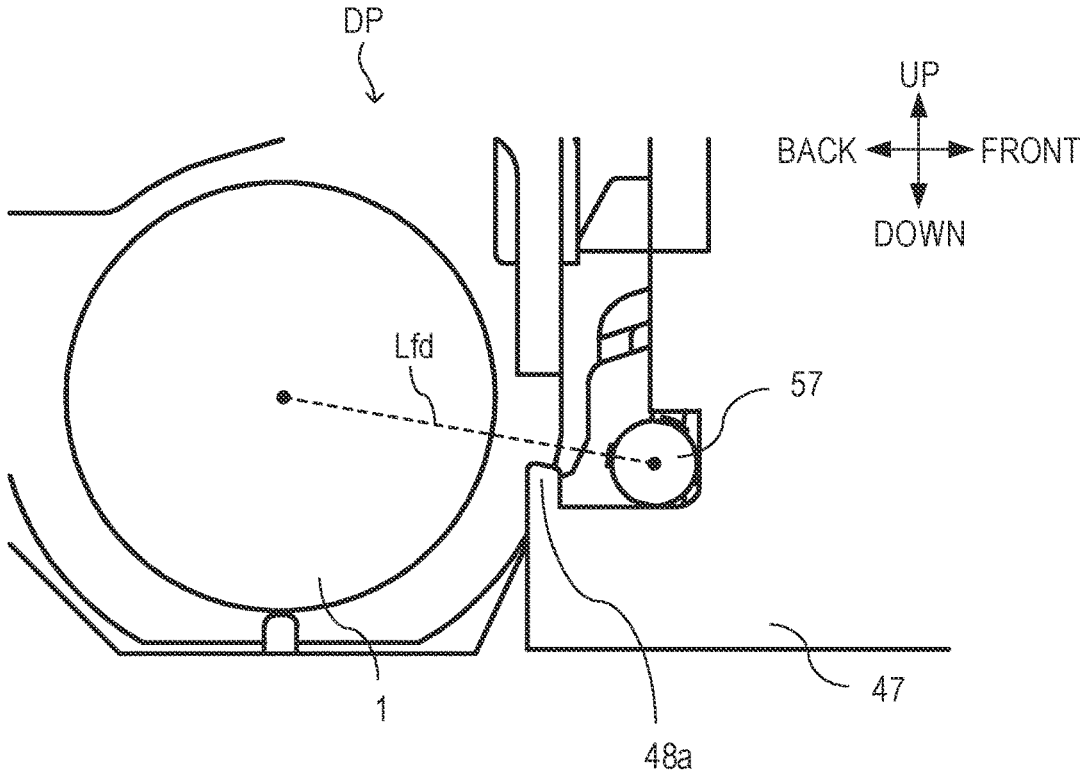
FIG. 11A and FIG. 11B are enlarged views showing a modification of the blocking member of the first embodiment.
Figure 11B:
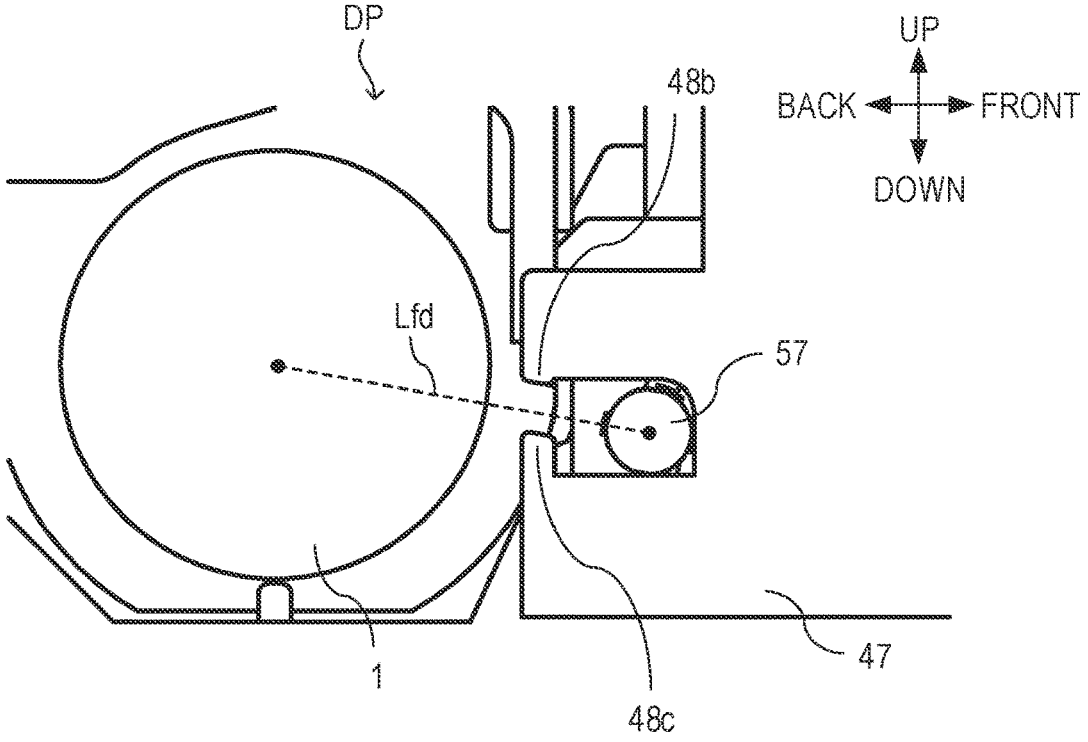

A modified example of the blocking member of the first embodiment will be described. FIG. 11A and FIG. 11B are views showing modifications of the blocking member 48. In the first embodiment, the blocking member 48 is arranged only on the upper portion of the light guide 57. However, the present disclosure is not limited thereto. For example, as shown in FIG. 11A, the blocking member 48*a* may be disposed on a lower portion of the light guide 57. As shown in FIG. 11B, the first blocking member 48*b* and the second blocking member 48*c* may be disposed on the upper portion and the lower portion of the light guide 57, respectively. That is, the second blocking member 48*c* may be provided on the side opposite to the first blocking member 48*b* with respect to the line Lfd. In either case, by changing the length of the blocking member 48*a*, the blocking member 48*b* or the blocking member 48*c* in the direction orthogonal to the line Lfd or the length in the horizontal direction, the light quantity of the light incident from the light emitting portion 58 to the photosensitive drum 1 can be adjusted.

Further, in the first embodiment, the light guide 57 is defined as a first light guide, and a sub-light guide 56, which is a second light guide, configured to introduce the light into the first light guide is provided between the light emitting portion 58 as a light source and the light guide 57 in the axial direction. However, the light from the light emitting portion 58 may be directly incident on the light guide 57 without providing the sub-light guide 56.

As described above, according to the first embodiment, in the configuration in which the light guide is provided in the pre-exposure unit, it is possible to suppress charge elimination unevenness in the longitudinal direction of the photosensitive drum.

[Blocking Member]

In the configuration of the image forming apparatus 100 applied in the second embodiment, the same members as those in the first embodiment are denoted by the same reference numerals and description thereof is omitted. In the first embodiment, the blocking member 48 is made of a member that does not transmit light. In the first embodiment, the blocking member 48 is configured to make the quantity of charge elimination on the photosensitive drum 1 uniform in the longitudinal direction by changing the shape of the blocking member 48.

Figure 12:
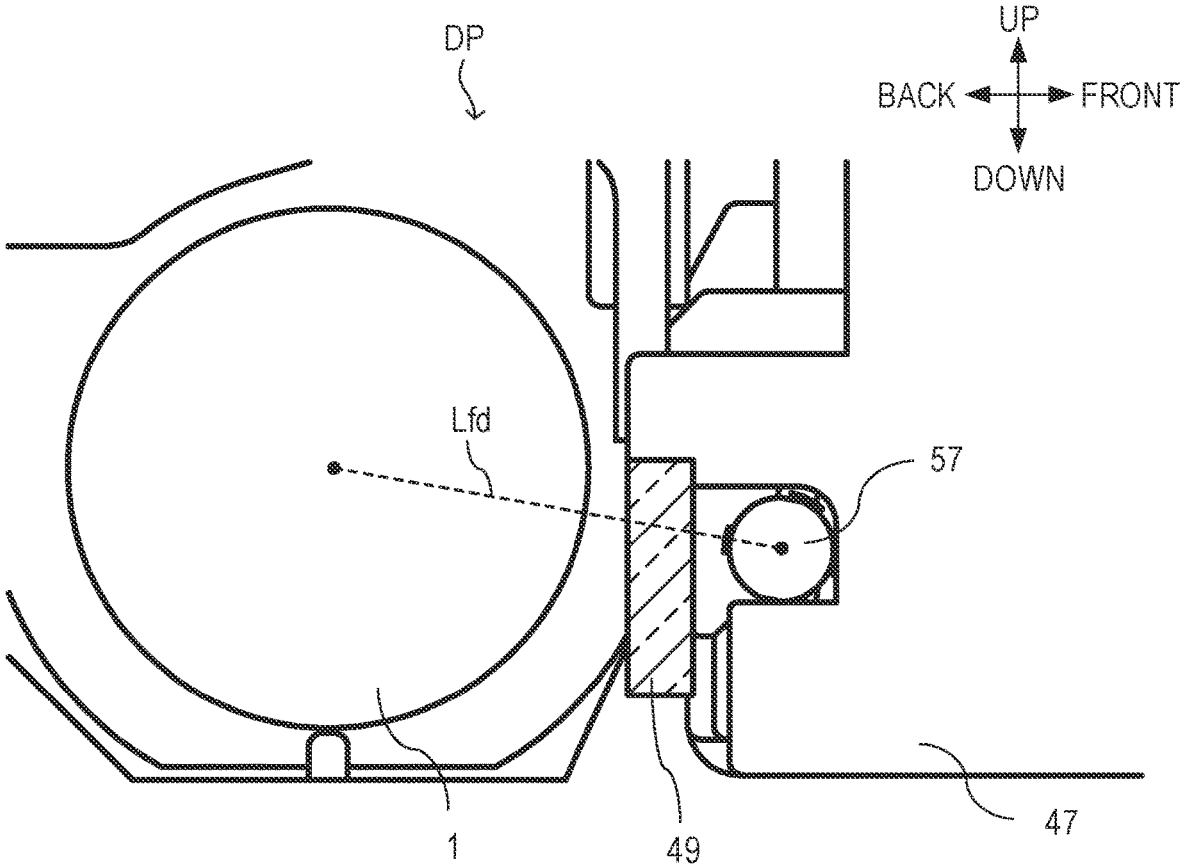
FIG. 12 is an enlarged view of a blocking member configured to attenuate a light quantity of a second embodiment.

FIG. 12 is a view for explaining a blocking member of the second embodiment. In the second embodiment, as shown in FIG. 12, an optical filter 49 configured to transmit and attenuate light is used as a blocking member. The optical filter 49 is disposed so that the light irradiated from the light guide 57 passes through the optical filter 49 and reaches the photosensitive drum 1. By providing the optical filter 49 to a portion in which the irradiation light quantity from the light emitting portion 58 is high, the irradiation light quantity can be reduced regardless of the position accuracy of the blocking member.

Figure 13A:
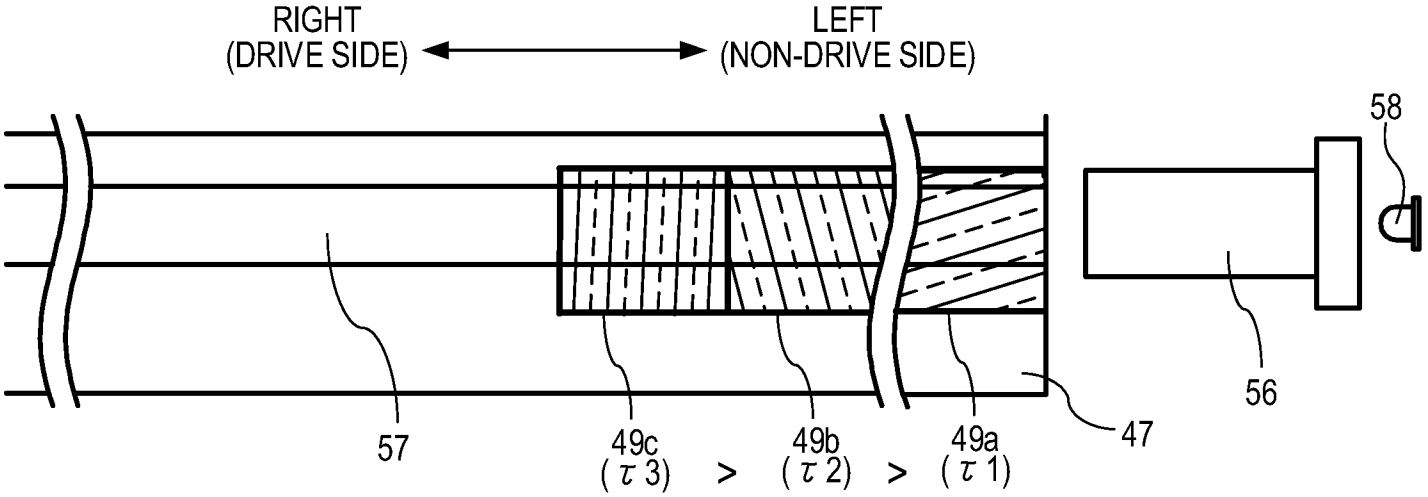
FIG. 13A and FIG. 13B are views showing other shapes of the blocking member configured to attenuate the light quantity of the second embodiment.
Figure 13B:
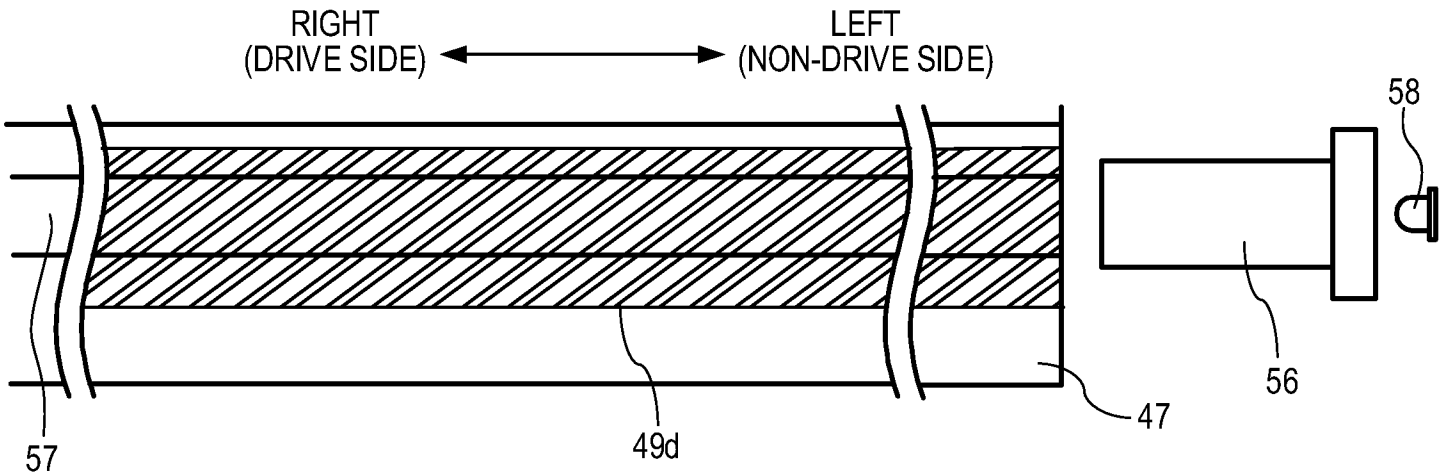

FIG. 13A and FIG. 13B are views showing configuration examples of the optical filter 49 of the second embodiment. As shown in FIG. 13A, in the longitudinal direction of the light guide 57, an optical filter 49 (49*a*, 49*b*, 49*c*) having a different transmittance may be provided by dividing the optical filter 49 in accordance with the light quantity emitted from the light emitting portion 58 to the photosensitive drum 1. More specifically, as shown in FIG. 13A, in order from the light source side, an optical filter 49*a* having a transmittance $\tau 1$, an optical filter 49*b* having a transmittance $\tau 2$, and an optical filter 49*c* having a transmittance $\tau 3$ are provided ($\tau 3 > \tau 2 > \tau 1$). Here, the optical filters 49*a*, 49*b*, and 49*c* are arranged so that the transmittance increases as the distance from the light source side increases. As described above, the blocking member as shown in FIG. 13A is the optical filter 49 which transmits the light irradiated from the pre-exposure unit 55, and has a plurality of optical filters 49*a*, 49*b*, and 49*c* which are arranged in the rotation axial direction of the photosensitive drum 1 and have different transmittance.

In addition, as shown in FIG. 13B, an optical filter 49*d* having different characteristics in transmittance distribution in accordance with the irradiation light quantity from the light emitting portion 58 to the photosensitive drum 1 may be used. Specifically, the optical filter 49*d* is provided along the longitudinal direction of the light guide 57. The optical filter 49*d* has such a characteristic that the further the distance from the light source side, the higher the transmittance. As described above, the blocking member as shown in FIG. 13B has a characteristic in which the transmittance is different in the rotation axial direction of the photosensitive drum 1, and has an optical filter 49*d* which transmits the light irradiated from the pre-exposure unit 55. Note that the optical filters 49*a*, 49*b*, and 49*c* of FIG. 13A and the optical filter 49*d* of FIG. 13B may be provided corresponding to a position (the cartridge tray 40 or the process cartridge PP) in which the light guide 57 is provided.

As described above, according to the second embodiment, in the configuration in which the light guide 57 is provided in the pre-exposure unit 55, it is possible to suppress charge elimination unevenness in the longitudinal direction of the photosensitive drum 1.

According to the present disclosure, in the configuration in which the light guide 57 is provided in the pre-exposure unit 55, it is possible to suppress charge elimination unevenness in the longitudinal direction of the photosensitive drum 1.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-170748, filed Oct. 8, 2020, which is hereby incorporated by reference herein in its entirety.

What is claimed is:

1. An image forming apparatus comprising:

a photosensitive conductor configured to be rotated;

a charging roller configured to charge a surface of the photosensitive conductor;

an exposure unit configured to form an electrostatic latent image on the surface of the photosensitive conductor charged by the charging roller;

a developing roller configured to develop the electrostatic latent image formed by the exposure unit with toner to form a toner image;

a transfer roller configured to transfer the toner image formed on the surface of the photosensitive conductor by the developing roller to a transfer-receiving member;

an irradiation unit having a light source provided at a first end of the irradiation unit in a rotation axial direction of the photosensitive conductor and a light guide configured to guide a light emitted from the light source in the rotation axial direction, wherein the irradiation unit is configured to irradiate the surface of the photosensitive conductor with the light after the toner image is transferred to the transfer-receiving member by the transfer roller; and a light shield configured to block the light irradiated from the irradiation unit in the rotation axial direction, wherein the light shield is configured so that a quantity of blocking the light irradiated from the irradiation unit is different in the rotation axial direction, wherein the light guide includes a first portion near the first end of the irradiation unit, a second portion away from the first end of the irradiation unit in the rotation axial direction of the photosensitive conductor, and a Fresnel portion dispersing the light for irradiating of the photosensitive conductor, wherein the quantity of blocking the light irradiated from the irradiation unit by the light shield is greater at the first portion than at the second portion in the rotation axial direction, and wherein a width in a direction perpendicular to a longitudinal direction of the light guide of the Fresnel portion at the second portion is wider than a width in the direction perpendicular to the longitudinal direction of the light guide of the Fresnel portion at the first portion.

2. The image forming apparatus according to claim 1, further comprising:

a cartridge having the photosensitive conductor, the charging roller, and the developing roller; and a tray which holds the cartridge and is insertable and removable with respect to the image forming apparatus while holding the cartridge, wherein the light shield is provided on the tray.

3. The image forming apparatus according to claim 1, wherein the quantity of blocking the light irradiated from the irradiation unit by the light shield is greater as closer, in the rotation axial direction, to the light source.

4. The image forming apparatus according to claim 1, wherein the light shield is configured so that a length of the light shield in a second direction parallel to a virtual line connecting the light guide and the photosensitive conductor is longer as closer to the light source.

5. The image forming apparatus according to claim 1, wherein the light shield includes a plurality of optical filters which transmit the light irradiated from the irradiation unit and which are arranged in the rotation axial direction and have different transmittance.

6. The image forming apparatus according to claim 5, wherein the light shield is configured so that transmittance becomes higher as further away from the light source in the rotation axial direction.

7. The image forming apparatus according to claim 1, wherein the quantity of blocking the light irradiated from the irradiation unit by the light shield is greater at the first end of the irradiation unit than at a second end opposite to the first end in the rotation axial direction.

8. The image forming apparatus according to claim 7, wherein the quantity of blocking the light irradiated from the irradiation unit by the light shield is greater as closer, in the rotation axial direction, to the light source.

9. The image forming apparatus according to claim 7, wherein the light shield is configured so that a length of the light shield in a second direction parallel to a virtual line connecting the light guide and the photosensitive conductor is longer as closer to the light source.

10. The image forming apparatus according to claim 1, further comprising a cartridge which has the photosensitive conductor, the charging roller, and the developing roller, and is insertable and removable with respect to the image forming apparatus, wherein the light shield is provided on the cartridge.

11. The image forming apparatus according to claim 1, wherein the light shield is configured so that a length of the light shield in a first direction orthogonal to a virtual line connecting the light guide and the photosensitive conductor is longer as closer to the light source.

12. The image forming apparatus according to claim 11, wherein the light shield is a first light shield, the image forming apparatus further comprising a second light shield provided on a side opposite to the first light shield with respect to the virtual line.

13. An image forming apparatus comprising:

a photosensitive conductor configured to be rotated;

a charging roller configured to charge a surface of the photosensitive conductor;

an exposure unit configured to form an electrostatic latent image on the surface of the photosensitive conductor charged by the charging roller;

a developing roller configured to develop the electrostatic latent image formed by the exposure unit with toner to form a toner image;

a transfer roller configured to transfer the toner image formed on the surface of the photosensitive conductor by the developing roller to a transfer-receiving member;

an irradiation unit having a light source provided at a first end of the irradiation unit in a rotation axial direction of the photosensitive conductor and a light guide configured to guide a light emitted from the light source in the rotation axial direction, wherein the irradiation unit is configured to irradiate the surface of the photosensitive conductor with the light after the toner image is transferred to the transfer-receiving member by the transfer roller; and a light shield configured to block the light irradiated from the irradiation unit, wherein in a first direction orthogonal to a virtual line connecting the light guide and the photosensitive conductor, a length of the light shield toward the virtual line at the first end of the irradiation unit is longer than a length of the light shield toward the virtual line at a center of the irradiation unit in the rotation axial direction, wherein the light guide includes a first portion near the first end of the irradiation unit, a second portion away from the first end of the irradiation unit in the rotation axial direction of the photosensitive conductor, and a Fresnel portion dispersing the light for irradiating of the photosensitive conductor, wherein the quantity of blocking the light irradiated from the irradiation unit by the light shield is greater at the first portion than at the second portion in the rotation axial direction, and wherein a width in a direction perpendicular to a longitudinal direction of the light guide of the Fresnel portion at the second portion is wider than a width in the direction perpendicular to the longitudinal direction of the light guide of the Fresnel portion at the first portion.

* * * * *